US010099898B2

(12) United States Patent
Quinn et al.

(10) Patent No.: US 10,099,898 B2
(45) Date of Patent: Oct. 16, 2018

(54) APPARATUS INCLUDES ELASTICALLY DEFORMABLE MEMBER HAVING TERMINAL ASSEMBLIES

(71) Applicants: Clayton Quinn, Edmonton (CA); James Douglas Hildebrand, Sturgeon County (CA)

(72) Inventors: Clayton Quinn, Edmonton (CA); James Douglas Hildebrand, Sturgeon County (CA)

( * ) Notice: Subject to any disclaimer, the term of this patent is extended or adjusted under 35 U.S.C. 154(b) by 0 days.

(21) Appl. No.: 15/250,234

(22) Filed: Aug. 29, 2016

(65) Prior Publication Data

US 2018/0057316 A1 Mar. 1, 2018

(51) Int. Cl.
*B66C 1/14* (2006.01)

(52) U.S. Cl.
CPC ..... *B66C 1/14* (2013.01)

(58) Field of Classification Search
CPC ..... B66C 1/22; B66C 1/14
USPC ..... 294/74, 81.2, 81.3, 81.4, 67.1, 67.21; 414/756
See application file for complete search history.

(56) References Cited

U.S. PATENT DOCUMENTS 1,599,353 A 9/1926 Albin
1,811,924 A * 6/1931 Fontaine ..... B66C 1/26 294/63.1
2,015,957 A 10/1935 Neal et al.
2,048,144 A * 7/1936 Showers, Jr. ..... B66C 1/125 294/81.3
2,462,972 A 3/1949 Johnson
2,880,963 A 4/1959 Ernst et al.
2,998,277 A * 8/1961 Himel, Jr. ..... B66C 1/14 191/12.2 R
3,547,276 A 12/1970 Thornburg
3,724,035 A 4/1973 Smith
4,040,305 A 8/1977 Cadic
4,193,627 A * 3/1980 Cranston ..... B66C 1/36 294/82.1
4,542,928 A * 9/1985 Fowler, Jr. ..... B66C 1/16 294/67.2

(Continued)

FOREIGN PATENT DOCUMENTS

CA 2892252 11/2016
CN 200974742 11/2007

(Continued)

OTHER PUBLICATIONS

Written opinion dated Jan. 8, 2018 on the corresponding P.C.T. patent application No. PCT/CA2017/051016 filed Aug. 29, 2017, 4 pages.

(Continued)

*Primary Examiner* — Paul T Chin
(74) *Attorney, Agent, or Firm* — Nissen Patent Law; Robert Anton Nissen

(57) ABSTRACT

An apparatus includes an elastically deformable member having a first portion and a second portion. Spaced-apart shackle assemblies each respectively define a jaw opening. The elastically deformable member is receivable in the jaw opening defined by each of the spaced-apart shackle assemblies. Terminal assemblies are configured to be respectively affixed to the first portion and the second portion-of the elastically deformable member.

20 Claims, 16 Drawing Sheets

(56) References Cited

U.S. PATENT DOCUMENTS 4,549,759 A * 10/1985 Fowler, Jr. ..... B66C 1/24 294/67.2
4,993,769 A * 2/1991 Chapalain ..... A44B 11/065 24/909
5,113,981 A * 5/1992 Lantz ..... A62B 35/04 182/3
5,308,101 A * 5/1994 Monty ..... B60D 1/182 267/74
5,688,011 A * 11/1997 Gulley ..... B66C 1/105 294/74
5,727,833 A * 3/1998 Coe ..... B66C 1/12 294/74
5,738,259 A 4/1998 Allen
5,836,632 A 11/1998 Pompa
6,009,754 A * 1/2000 Casas ..... G01V 3/165 324/326
6,014,794 A * 1/2000 McCoy ..... B62J 7/08 24/265 H
6,050,587 A * 4/2000 Panhausen ..... B60D 1/18 280/480
6,161,769 A * 12/2000 Kircher ..... F25C 3/04 239/135
6,331,024 B1 12/2001 Gulley
6,871,387 B2 * 3/2005 Cheng ..... H01R 11/24 24/499
6,939,269 B2 * 9/2005 Makofsky ..... A63B 21/154 482/10
7,458,135 B2 * 12/2008 Mikesell ..... B25H 3/006 24/300
7,905,527 B1 * 3/2011 Smallin ..... B66F 19/00 294/66.1
8,388,032 B2 3/2013 Mamie et al.
8,413,923 B2 * 4/2013 Brenner ..... B64C 27/001 244/17.11
8,459,514 B2 * 6/2013 Lagzdins ..... A47G 25/32 223/89
8,590,116 B2 * 11/2013 Dahl ..... D07B 1/18 24/300
8,852,018 B1 * 10/2014 Hanley ..... A63B 47/02 294/19.2
8,905,448 B2 * 12/2014 Vaz Coelho ..... B66C 1/66 294/74
8,997,317 B2 * 4/2015 Rinklake ..... A62B 35/04 24/300
9,692,154 B2 * 6/2017 Page ..... H01R 11/24
2006/0208513 A1 * 9/2006 Summars ..... B66C 1/12 294/74
2009/0102213 A1 * 4/2009 Ritchie ..... B66C 1/12 294/74
2009/0266287 A1 10/2009 Neidermair
2011/0052314 A1 * 3/2011 Lindsey ..... B66C 1/12 403/210
2013/0091621 A1 * 4/2013 Lu ..... A41F 3/00 2/326
2015/0001330 A1 1/2015 O'Kane
2015/0316921 A1 * 11/2015 Atherton ..... G05B 19/4065 700/114
2016/0249759 A1 * 9/2016 Piraino ..... A47G 25/4053 34/240
2016/0347581 A1 * 12/2016 Quinn ..... B60D 1/58

FOREIGN PATENT DOCUMENTS

| | | |
|---|---|---|
| EP | 0842796 | 5/1998 |
| EP | 1608580 | 6/2011 |
| FR | 3035095 | 10/2016 |
| JP | 5282902 | 9/2013 |
| KR | 101333582 | 11/2013 |

OTHER PUBLICATIONS

International Search Report dated Jan. 8, 2018 on the corresponding P.C.T. patent application No. PCT/CA2017/051016 filed Aug. 29, 2017, 4 pages.

* cited by examiner

APPARATUS INCLUDES ELASTICALLY DEFORMABLE MEMBER HAVING TERMINAL ASSEMBLIES

TECHNICAL FIELD

This document relates to the technical field of (and is not limited to) an apparatus including an elastically deformable member, terminal assemblies affixed to the elastically deformable member (and method therefor).

BACKGROUND

Moving assemblies (such as tow trucks) or lifting assemblies, such as a crane, are machines equipped with a hoist, wire ropes or chains (a sling), and/or sheaves configured to move (lift and/or lower) a load (materials) and to move them horizontally and/or vertically. The lifting assembly is used for lifting heavy objects and transporting them to other places. The lifting assembly is configured to lift (lower, move) loads beyond the normal capability of a human. The lifting assembly may be used for the loading and unloading of freight, for the movement of construction materials, and/or for the assembling of heavy equipment, etc.

SUMMARY

It will be appreciated that there exists a need to mitigate (at least in part) at least one problem associated with existing moving assemblies such as, lifting assemblies, etc., and also called the existing technology. After much study of the known systems and methods with experimentation, an understanding of the problem and its solution has been identified and is articulated as follows:

The existing technology suffers from the unwanted formation of potential pinch points (or a line of fire) along the sling, and may lead to the unsafe operation of the moving assembly (for moving a load), such as a lifting assembly (for lifting a load), etc.

To mitigate, at least in part, at least one problem associated with the existing technology, there is provided (in accordance with a first major aspect) an apparatus. The apparatus is for a moving assembly. The moving assembly is configured to move a load via a sling assembly operatively connectable to the load. The sling assembly has a first sling connection portion and a second sling connection portion. The apparatus includes a sling tensioning assembly. The sling tensioning assembly has a first connection portion. The sling tensioning assembly also has a second connection portion. The second connection portion is spaced apart from the first connection portion. The sling tensioning assembly is configured, in use, to remove the slack from the sling assembly. A connector assembly is configured to connect the first connection portion of the sling tensioning assembly to the first sling connection portion of the sling assembly. The connector assembly is also configured to connect the second connection portion of the sling tensioning assembly to any one of the second sling connection portion of the sling assembly and the load.

To mitigate, at least in part, at least one problem associated with the existing technology, there is provided (in accordance with a second major aspect) an apparatus. The apparatus is for a load. The apparatus includes a sling assembly operatively connectable to the load. The sling assembly has a first sling connection portion and a second sling connection portion. The second sling connection portion is spaced apart from the first sling connection portion.

A moving assembly is configured to move the load via the sling assembly. A sling tensioning assembly has a first connection portion and also has a second connection portion. The second connection portion is spaced apart from the first connection portion. The sling tensioning assembly is configured, in use, to remove the slack from the sling assembly. A connector assembly is configured to connect the first connection portion of the sling tensioning assembly to the first sling connection portion of the sling assembly. The connector assembly is also configured to connect the second connection portion of the sling tensioning assembly to any one of the second sling connection portion of the sling assembly and the load.

To mitigate, at least in part, at least one problem associated with the existing technology, there is provided (in accordance with a third major aspect) an apparatus. The apparatus includes an elastically deformable member having opposite end portions.

In accordance with a specific embodiment, spaced-apart shackle assemblies each respectively define a yoke opening. The elastically deformable member is receivable in the yoke opening defined by each of the spaced-apart shackle assemblies. Terminal assemblies are configured to be respectively affixed to each respective opposite end portions of the elastically deformable member.

To mitigate, at least in part, at least one problem associated with the existing technology, there is provided (in accordance with a fourth major aspect) an apparatus. The apparatus includes an elastically deformable member having a first portion and a second portion spaced apart from the first portion. Spaced-apart shackle assemblies each respectively define a jaw opening. The elastically deformable member is receivable in the jaw opening defined by each of the spaced-apart shackle assemblies. Terminal assemblies are configured to be respectively affixed to the first portion and the second portion (such as, and not limited to, each respective opposite end portion) of the elastically deformable member.

To mitigate, at least in part, at least one problem associated with the existing technology, there is provided (in accordance with a fifth major aspect) a method. The method is for operating an apparatus having an elastically deformable member, spaced-apart shackle assemblies, and terminal assemblies. The method includes (A) receiving the elastically deformable member in jaw openings defined by spaced-apart shackle assemblies, in which the elastically deformable member has a first portion and a second portion spaced apart from the first portion, and (B) respectively affixing the terminal assemblies to the first portion and the second portion of the elastically deformable member.

To mitigate, at least in part, at least one problem associated with the existing technology, there is provided (in accordance with a sixth major aspect) an apparatus. The apparatus includes an elastically deformable member having a first portion and a second portion being spaced apart from the first portion opposite end portions. A first terminal assembly and a second terminal assembly spaced apart from the first terminal assembly. The first portion and the second portion opposite end portions of the elastically deformable member are respectively fixedly connected to the first terminal assembly and the second terminal assembly.

In accordance with a preferred embodiment, there is also provided is a first shackle assembly and a second shackle assembly spaced apart from the first shackle assembly. The first terminal assembly and the second terminal assembly are respectively positioned to (preferably coupled to) the first shackle assembly and the second shackle assembly.

To mitigate, at least in part, at least one problem associated with the existing technology, there is provided (in accordance with a seventh major aspect) an apparatus. An apparatus includes an elastically deformable member having opposite end portions. A first terminal assembly and a second terminal assembly are spaced apart from the first terminal assembly. The opposite end portions of the elastically deformable member are respectively fixedly connected to the first terminal assembly and the second terminal assembly.

In accordance with a preferred embodiment, a first shackle assembly and a second shackle assembly are spaced apart from the first shackle assembly. The first terminal assembly and the second terminal assembly are respectively positioned to (preferably or optionally coupled to) the first shackle assembly and the second shackle assembly.

To mitigate, at least in part, at least one problem associated with the existing technology, there is provided (in accordance with an eighth major aspect) an apparatus. The apparatus includes a load. A moving assembly is configured to move the load. A load line is connected to the moving assembly and the load. The load line has spaced-apart points positioned on the load line. An elastically deformable member is connected to the spaced-apart points of the load line.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which:

FIG. 2 depicts a side view of an embodiment of a moving assembly, a load and a sling assembly;

Figure 1:
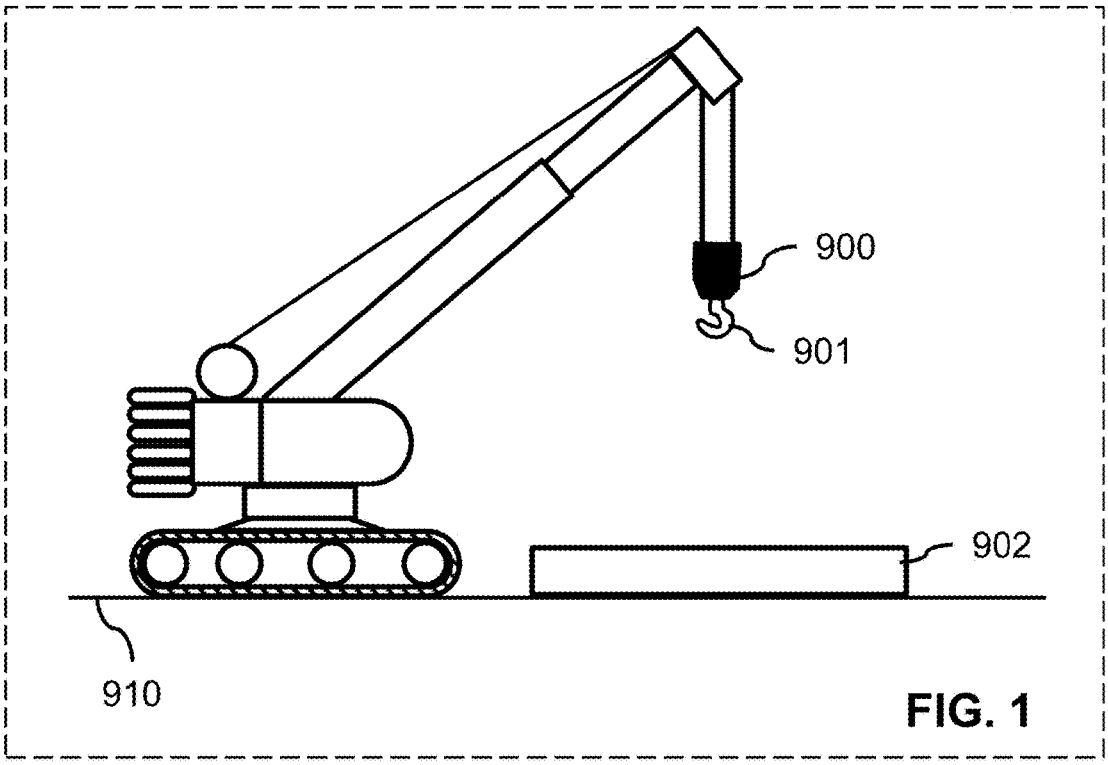
FIG. 1 and FIG. 2 depict side views of embodiments of a moving assembly and a load.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 apparatus
102 sling tensioning assembly
104 first connection portion
106 second connection portion
108 connector assembly
110 elastically deformable member
111 connection
112 first connector
114 second connector
116 articulation assembly
117 jaw opening
118A first shackle assembly
118B second shackle assembly
118C load shackle assembly
118 shackle assemblies, shackle assembly, or spaced-apart shackle assemblies
119 crown
120 spaced-apart lugs
121 common elongated longitudinal axis
122 coaxially-aligned threaded shackle holes
124 shackle pin, or shackle bolt
125 protective flexible cover
126A first terminal assembly
126B second terminal assembly
126 terminal assemblies, or terminal assembly
127 internal block cavity
128 connection member
129 flange
130 first terminal portion
131 block channel
132 second terminal portion
134 connector, or connectors
136 connector holes
138 terminal lock, or shackle lock
140 block extension
141 rear portion
142 hook assembly
143 lock channel
144A first lifting ring
144B second lifting ring
144 main lifting ring
145 eye

900 moving assembly
901 movable-node point
902 load
904A first sling assembly
904B second sling assembly
904 sling assembly (also called a load line)
906 first sling connection portion
908 second sling connection portion
910 working surface
912 choke sling, or sling hook-up point
914 lug assembly
916 shackle assembly
918 clamp device
920 hook-up, or spaced-apart hook-ups

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

Figure 2:
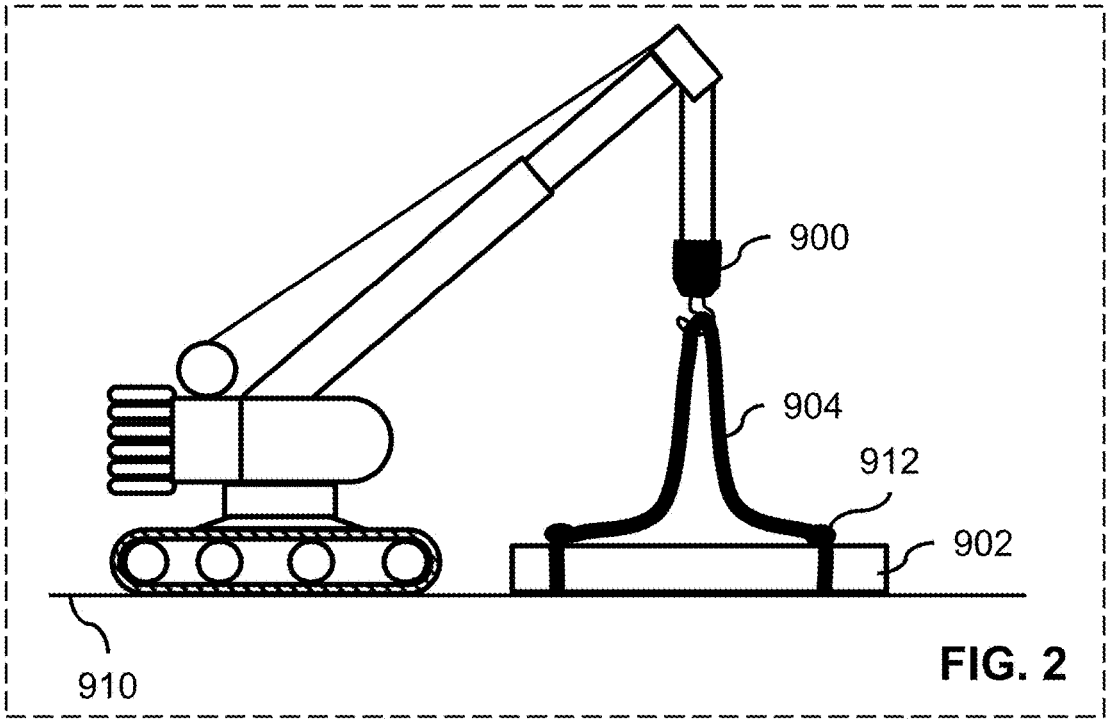

FIG. 1 and FIG. 2 depict side views of embodiments of a moving assembly 900 and a load 902.

The moving assembly 900 is configured to move (lift, etc.) the load 902 once the moving assembly 900 is operatively coupled (connected) to the load 902, and the moving assembly 900 is operated to do just so. The moving assembly 900 is configured to support the load 902 while moving (such as, lifting, moving, lowering, etc.) the load 902 above a working surface 910. It will be appreciated that the definition of moving includes lifting, lowering, moving, etc. By way of a specific embodiment, the moving assembly 900 may include a crane, a boom truck or an overhead crane, a chain fall, a rigged-lifting system, a spreader bar system, an engineered system, a heli portable (also called a helicopter portable remote drilling rig), a lifting system for a helicopter, a helicopter configured to lift and/or move a load, or any mechanical system configured to provide a lifting force or a moving force, etc., and any equivalent thereof. The moving assembly 900 includes a movable-node point 901. The movable-node point 901 may include a lifting hook, etc., and any equivalent thereof. The movable-node point 901 is configured to move (lift or lower) the sling assembly 904. The sling assembly 904 is also called a load line, a load connector, and any equivalent thereof. The sling assembly 904 is any device configured to connect a load to a load-moving system.

The moving assembly 900 may include a lifting assembly, a lateral-moving assembly, etc., and any equivalent thereof. The moving assembly 900 may be configured to move the load 902 in any desired direction.

In accordance with the embodiment as depicted in FIG. 2, the load 902 includes a choke sling 912 (also called a sling hook-up point). The choke sling 912 may include, for instance, a cable, a wire, a rope, a chain, a load connector line, etc., any combination and/or permutation thereof, and any equivalent thereof (and/or in any number of instances thereof). The choke sling 912 is located at each position in which the sling assembly 904 is to make an operative attachment to the load 902. The sling assembly 904 may include, for instance, a cable, a wire, a rope, a chain, etc., and any equivalent thereof (in any number of instances thereof). The sling assembly 904 is configured to extend from the load 902 to the movable-node point 901 of the moving assembly 900. The sling assembly 904 is configured to be operatively connectable to the choke sling 912 of the load 902 and to the movable-node point 901 of the moving assembly 900. In operation, the moving assembly 900 is configured to lift (move) the load 902 via the sling assembly 904.

It will be appreciated that there may be many instances of the choke sling 912 as may be required to lift the load 902. For the case where multiple instances of the choke sling 912 are deployed, the moving assembly 900 does not have to keep resetting (in order to move the load 902). The sling tensioning assembly 102 is configured to hold, in use, the sling assembly 904 in place and to ensure a smooth movement of the sling assembly 904. The sling tensioning assembly 102 is configured, in use, to remove (at least in part) slack from the sling assembly 904.

Referring to the embodiment as depicted in FIG. 1, the load 902 rests on the working surface 910 (such as, the ground surface).

Referring to the embodiment as depicted in FIG. 2, the movable-node point 901 (the hook) is connected to the load 902 via the sling assembly 904. The sling assembly 904 is free to move around because there is slack in the sling assembly 904. As the moving assembly 900 (depicted as the crane) pulls the sling assembly 904 upwardly, the length of the sling assembly 904 changes and may inadvertently result in an uneven orientation of the load 902 (as the load 902 is lifted away from (or moved relative to) the working surface 910). Once the load 902 is lifted (moved) with an uneven orientation, the moving assembly 900 may attempt to reposition any one of the sling assembly 904 and/or the load 902, thereby potentially placing a worker (located on the working surface 910 proximate to the load 902) in a dangerous position and/or causing inadvertent damage to the load 902.

FIGS. 3, 4, 5, 6 and 7 depict side views of embodiments of an apparatus 100 for the moving assembly 900, the load 902 and the sling assembly 904 of FIG. 2.

Figure 3:
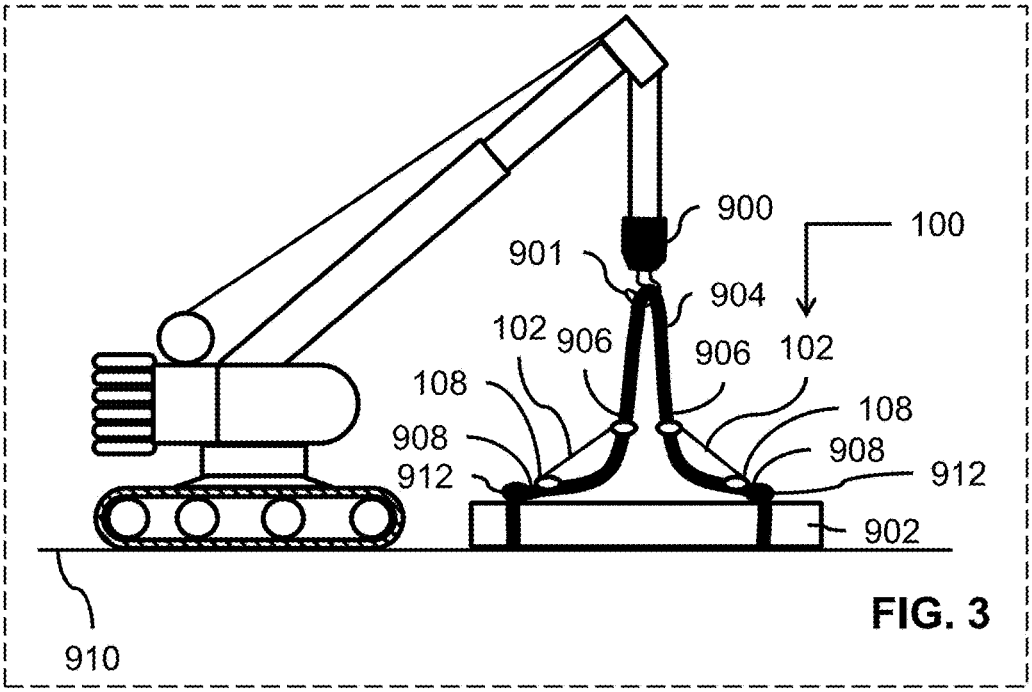
FIG. 3, FIG. 4, FIG. 5, FIG. 6, FIG. 7, FIG. 8A and FIG. 8B depict side views of embodiments of an apparatus for the moving assembly, the load and the sling assembly of FIG. 2.
Figure 4:
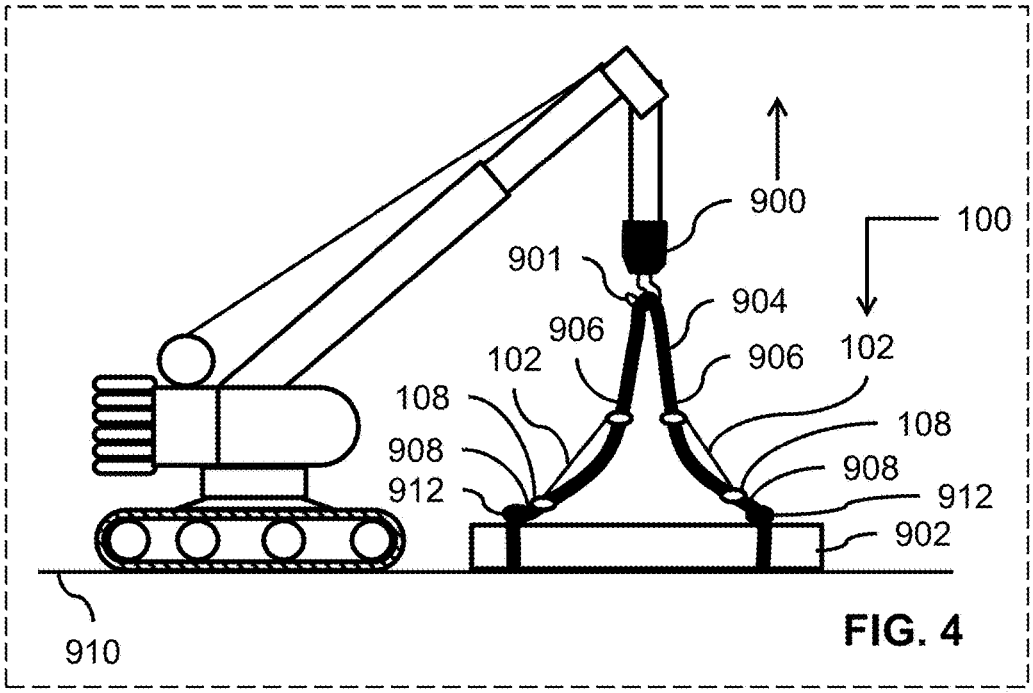
Figure 5:
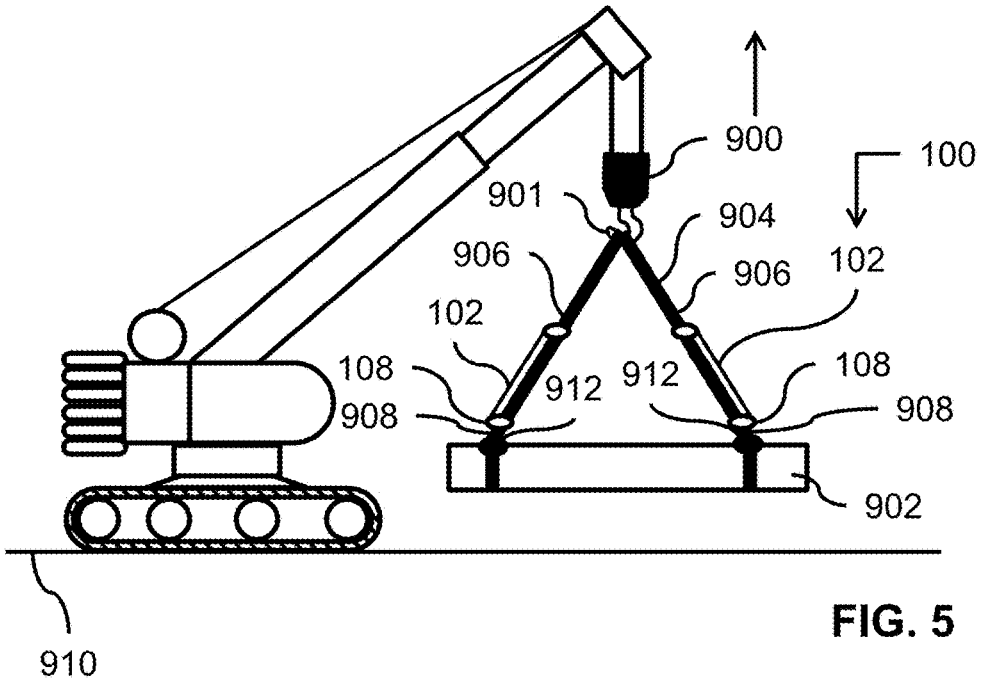

Referring to the embodiments as depicted in FIGS. 3, 4 and 5, in accordance with a first major embodiment, the apparatus 100 is for the moving assembly 900 that is configured to lift (move) the load 902 via the sling assembly 904. The sling assembly 904 is operatively connectable to the load 902. The sling assembly 904 has the first sling connection portion 906 and the second sling connection portion 908. The second sling connection portion 908 is spaced apart from the first sling connection portion 906. It will be appreciated that the apparatus 100 does not include the moving assembly 900, the load 902 and the sling assembly 904.

In accordance with the first major embodiment, the apparatus 100 includes (and is not limited to) a synergistic combination of the sling tensioning assembly 102 and the connector assembly 108. The sling tensioning assembly 102 has a first connection portion 104. The sling tensioning assembly 102 also has a second connection portion 106 that is spaced apart from the first connection portion 104. The sling tensioning assembly 102 is configured, in use, to remove the slack from the sling assembly 904. The connector assembly 108 is configured to connect the first connection portion 104 of the sling tensioning assembly 102 to the first sling connection portion 906 of the sling assembly 904. The connector assembly 108 is also configured to connect the second connection portion 106 of the sling tensioning assembly 102 to any one of the second sling connection portion 908 of the sling assembly 904 and the load 902.

A technical effect of the sling tensioning assembly 102 is that, in use, the sling tensioning assembly 102 reduces (preferably eliminates) the formation of potential pinch points (or a line of fire) along the sling assembly 904, and thereby the sling assembly 904 improves (at least in part) user safety for the case where the sling tensioning assembly 102 is used in the process of lifting (moving) the load 902.

FIG. 3, FIG. 4, FIG. 5, FIG. 6, FIG. 7, FIG. 8A and FIG. 8B depict side views of embodiments of an apparatus 100 for the moving assembly 900, the load 902 and the sling assembly 904 of FIG. 2.

Referring to the embodiment as depicted in FIG. 3, the apparatus 100 is operatively attached to the sling assembly 904. Preferably, the sling tensioning assembly 102 is operatively attached to the sling assembly 904 at each branch of the sling assembly 904 that is operatively connected to the load 902.

Referring to the embodiment as depicted in FIG. 4, the moving assembly 900 lifts (moves), in use, the sling assembly 904 (vertically) from the movable-node point 901 of the moving assembly 900. Generally, the sling tensioning assembly 102 (once installed) is configured to take out (remove), at least in part, slack from the sling assembly 904. Preferably, the sling tensioning assembly 102 (once installed) is configured to take out (remove), at least in part, slack from the sling assembly 904 before any one of the sling assembly 904 and the load 902 is lifted from (moved relative to) the working surface 910. In accordance with an option, the sling tensioning assembly 102 (once installed) is configured to stretch out (to lengthen), at least in part, once any one of the sling assembly 904 and the load 902 is/are lifted from (moved relative to) the working surface 910.

In accordance with a first option, the sling tensioning assembly 102 is installed to the sling assembly 904 (at spaced apart sling positions located on the sling assembly 904). In accordance with a second option, the sling tensioning assembly 102 is installed to a sling position on the sling assembly 904 and the choke sling 912 (the point where the sling assembly 904 is attached to the load 902). The choke sling 912 is operatively attached to the load 902, and the choke sling 912 is configured to be attachable to the sling assembly 904.

Another technical advantage of the sling assembly 904 is that the sling assembly 904 (A) reduces (at least in part) a possibility that the sling assembly 904 may become loose (before the sling assembly 904 is lifted or is moved), and in this manner the sling assembly 904 may improve safety for the case where the load 902 is lifted (moved) by the action of the sling assembly 904 and the moving assembly 900, and/or (B) reduces, at least in part, the potential of risk of injury to users or workers.

In accordance with an option, the sling tensioning assembly 102 includes an elastically deformable member 110.

In accordance with a second major embodiment, the apparatus 100 is for use with the load 902. It will be appreciated that the apparatus 100 does not include the load 902. In accordance with the second major embodiment, the apparatus 100 includes (and is not limited to) a synergistic combination of the sling assembly 904, the moving assembly 900, the sling tensioning assembly 102, and the connector assembly 108.

Referring to the embodiment as depicted in FIGS. 3 and 4, one end of the sling tensioning assembly 102 is attached to a point located proximate to (just above or at) the choke sling 912. Then, the sling assembly 904 that extends from the movable-node point 901 is pulled relatively tighter so that the opposite end (another end) of the sling tensioning assembly 102 may be attached (by the user) to the sling assembly 904 (at a position that is spaced apart from the choke sling 912 and closer to the movable-node point 901). In this manner, the sling tensioning assembly 102 (once attached) is configured to reduce (preferably prevent) movement of the sling assembly 904 once the movable-node point 901 is lifted (moved) upwardly (as depicted in FIG. 4).

Referring to the embodiment as depicted in FIG. 5, as the movable-node point 901 hoists up, the workers located on the working surface 910 may remain positioned away from the load 902 and clear of any imminent danger simply because no worker is required to be positioned near the load 902 as the load 902 is lifted (moved) upwardly. The sling tensioning assembly 102 is configured to keep the sling assembly 904 relatively slack free (at least in part) as the sling assembly 904 is lifted in such a way that the load 902 is moved above (relative to) the working surface 910. As the load 902 is lifted (moved), the sling assembly 904 experiences fewer (preferably, no) pinch points or crush points, etc. As the movable-node point 901 hoists up (lifts or moves) the sling assembly 904, the sling assembly 904 becomes, in use, stretched (or fully extended to an extended length), and the load 902 is lifted (moved) as evenly as possible (for instance, for the case where the sling assembly 904 was initially set or affixed to the load 902 prior to lifting (moving) of the sling assembly 904).

Figure 6:
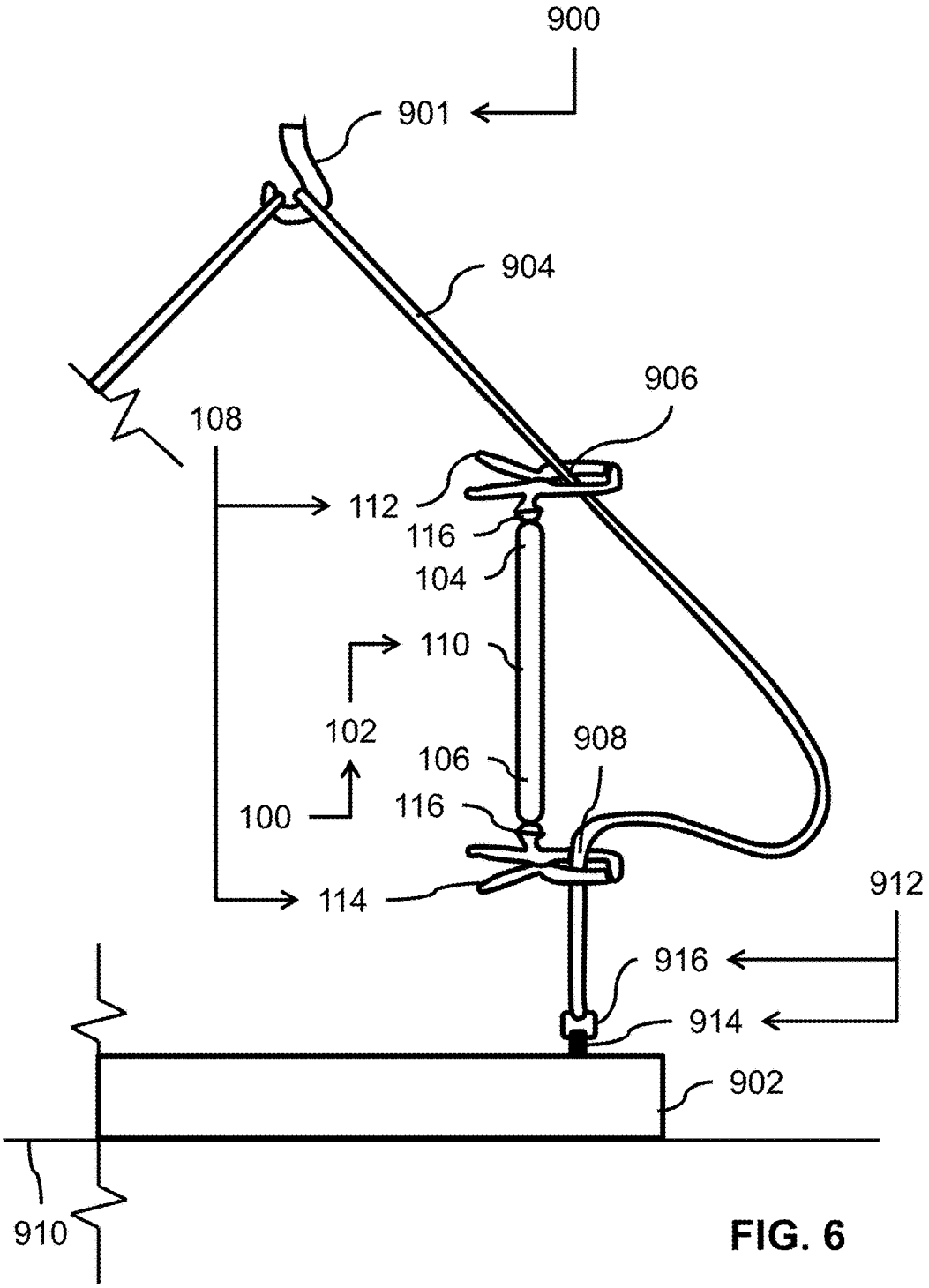
Figure 7:
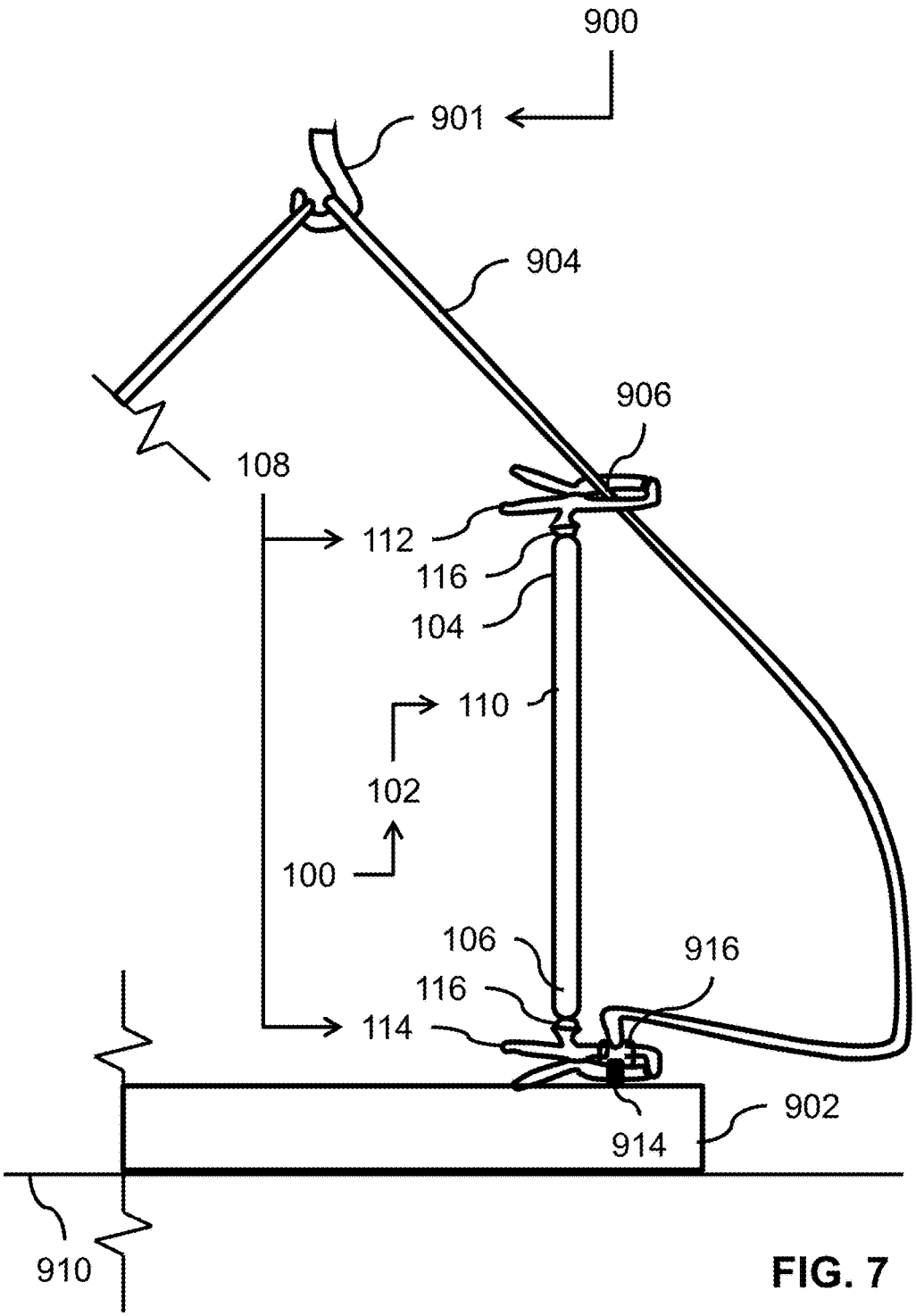

Referring to the embodiments as depicted in FIGS. 6 and 7, the choke sling 912 includes any one of a lug assembly 914 and a shackle assembly 916. The lug assembly 914 is configured to be affixed to the load 902. The shackle assembly 916 is configured to couple the lug assembly 914 to an end section of the sling assembly 904.

The shackle assembly 916 may include, for instance, a U-shaped body (made with a strong material, such as metal) that is configured to be secured with a lock (a clevis pin or bolt) across the opening of the U-shaped body. The shackle assembly 916 may include a hinged loop secured with a locking mechanism, such as a quick-release locking pin mechanism, etc. The shackle assembly 916 may include a handcuff device and other similarly conceived restraint devices that function or operate in a similar manner. The shackle assembly 916 may be called a connecting-link assembly. The shackle assembly 916 is configured to be utilized in many types of rigging systems (such as industrial crane rigging). The shackle assembly 916 is configured to allow different rigging subsets to be connected or disconnected. In addition, the shackle assembly 916 may include a padlock. The term "shackle assembly" covers the above embodiments of the shackle assembly 916 and any equivalent thereof.

As the movable-node point 901 is lifted (moved), the sling tensioning assembly 102 is stretched (becomes lengthened), until the sling assembly 904 is tight.

In accordance with an embodiment, the elastically deformable member 110 includes, in accordance with an embodiment, a collection of at least one or more bungee cords, a bungee cord, an elastic cord, a shock cord, a contractible and expandable assembly, and any equivalent thereof (and not limited thereto). The elastically deformable member 110 may be called contractible and expandable assembly. The length of the elastically deformable member 110 may be (for instance) about 18 inches. The length of the elastically deformable member 110 may be shorter the length of the sling assembly 904. The sling tensioning assembly 102 may be (for instance) waterproof (that is, has a waterproof casing). In accordance with an embodiment, the connector assembly 108 includes a first connector 112 configured to be connectable to the first sling connection portion 906 of the sling assembly 904, and a second connector 114 configured to be connectable to any one of (A) the second sling connection portion 908 of the sling assembly 904, (B) the load 902, and (C) the choke sling 912.

In accordance with an embodiment, the first connector 112 and the second connector 114 include an articulation assembly 116 (such as, a ball and socket assembly). The articulation assembly 116 is configured to provide articulation action (in use) between the sling tensioning assembly 102 and the sling assembly 904. The ball and articulation assembly 116 is configured to be operatively connected to distal ends of the sling tensioning assembly 102. The first connector 112 and the second connector 114 may include clamping devices having a quick-release device that is configured to release the application of a clamping force to be applied by the clamping device, etc.

Figure 8A:
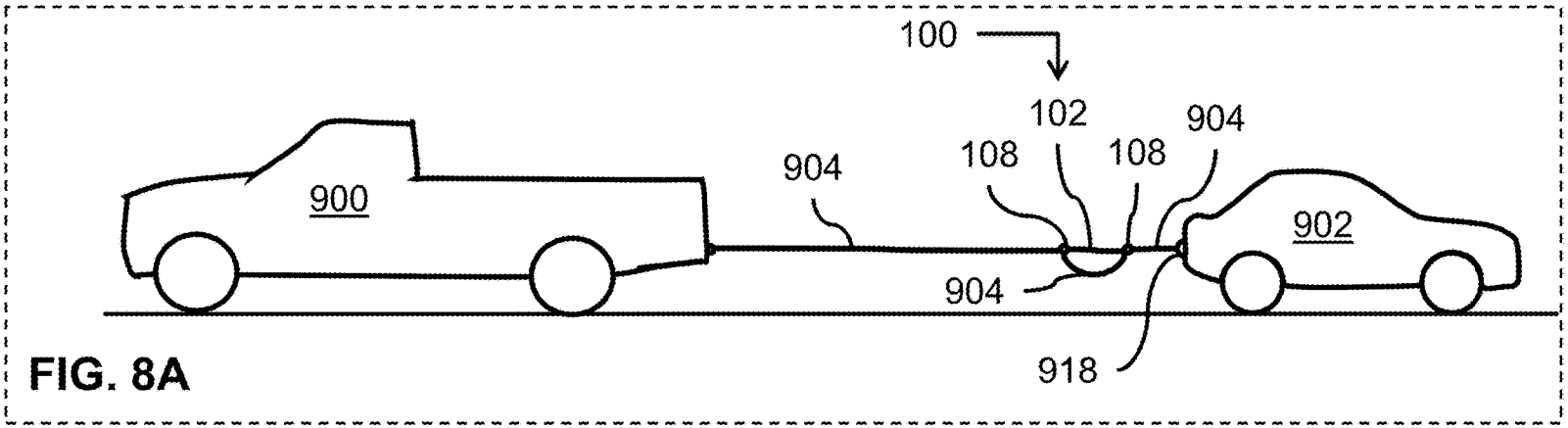
Figure 8B:
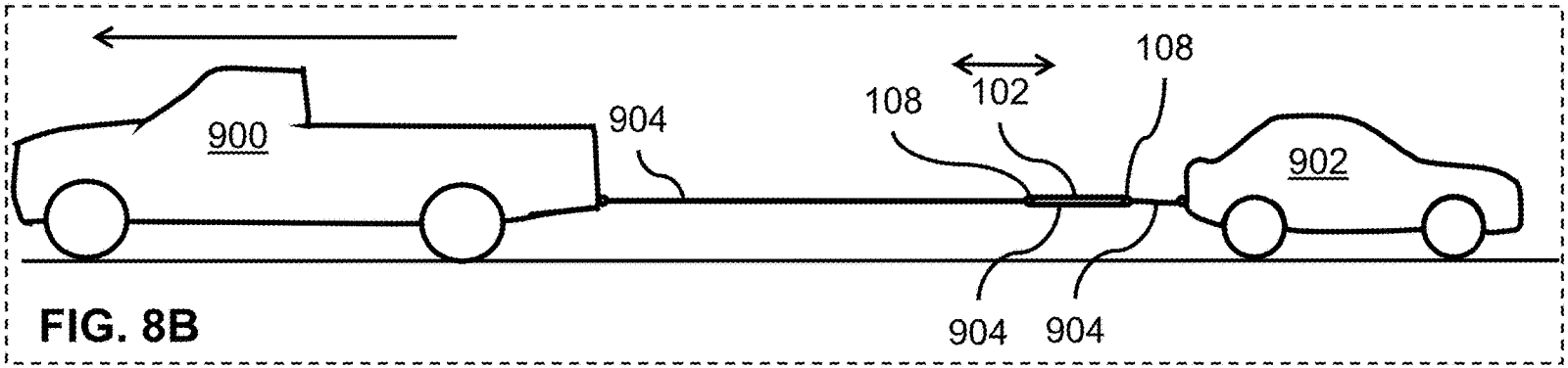

Referring to the embodiment as depicted in FIG. 8A and FIG. 8B, the connector assembly 108 includes a stitching material configured to stitch (fixedly connect) the sling tensioning assembly 102 to the sling assembly 904 (that is, to the first sling connection portion and the second sling connection portion of the sling assembly 904). A clamp device 918 connects the sling assembly 904 to the load 902. The load 902 is depicted as a car, and the moving assembly 900 is depicted as a pick-up truck. The sling assembly 904 is fixedly attached to the car and the truck (as depicted in FIG. 8A). Referring to the embodiment as depicted in FIG. 8B, the moving assembly 900 (depicted as a truck) is moved in such a way that the moving assembly 900 pulls the sling assembly 904 tightly.

FIGS. 9 to 12 depict front views (FIGS. 9 and 10), and side views (FIGS. 11 and 12) of the embodiments of the apparatus 100.

Figure 9:
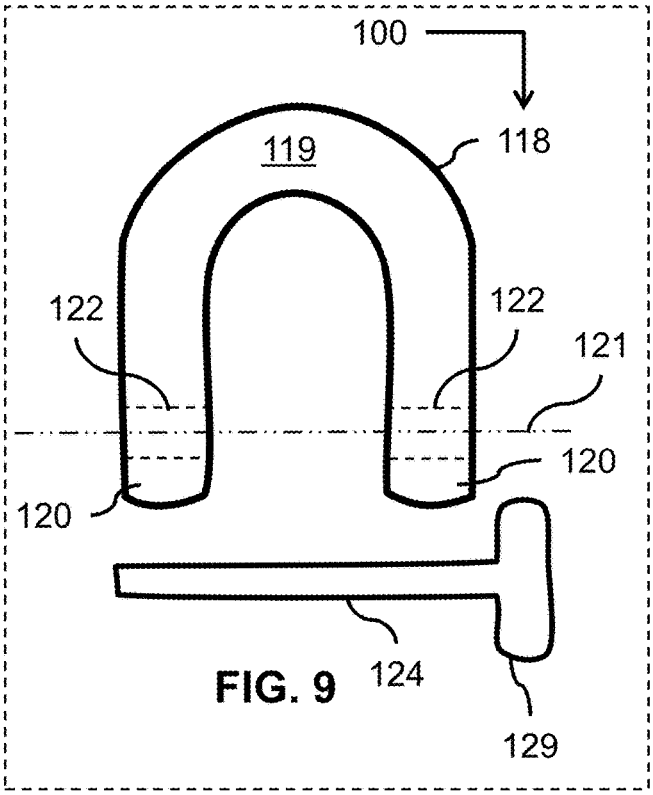
FIGS. 9 to 12 depict front views (FIGS. 9 and 10), and side views (FIGS. 11 and 12) of embodiments of an apparatus.

In accordance with the embodiment as depicted in FIG. 9, the apparatus 100 includes a shackle assembly 118. Preferably, the shackle assembly 118 includes a crown 119 (preferably having a metal component). The crown 119 includes, for instance, a metal alloy (a strength component, etc.) that is configured to withstand receiving and transmitting relatively heavy loads as may be required or suitable for a specific-load carrying ability. Preferably, the crown 119 has spaced-apart lugs 120 (spaced-apart extending prongs). The spaced-apart lugs 120 are aligned parallel to each other (coaxially spaced apart), and have a similar linear length. The spaced-apart lugs 120 extend (radially or outwardly) from the crown 119. Each of the spaced-apart lugs 120 include spaced-apart end sections (end portions). Each of the spaced-apart end sections (of the spaced-apart lugs 120) defines coaxially-aligned threaded shackle holes 122 in which a common elongated longitudinal axis 121 extends therethrough.

The shackle assembly 118 may be called a hook receive, a hook-receiver assembly, and any equivalent thereof. The terminal assemblies 126 may be called a hook or a hook assembly, and any equivalent thereof.

The terminal assembly 126 may be called an endpoint assembly, a point assembly, a connector assembly, or a terminus assembly, a mechanical terminal assembly. Preferably, for convenience, the terminal assemblies 126 are configured to respectively connect to the end points of the elastically deformable member 110. Generally, the terminal assemblies 126 are configured to connect to respective spaced-apart points positioned on (or spaced-apart portions of) the elastically deformable member 110. The terminal assembly 126 is configured to join or fasten to a portion (a predetermined portion) of the elastically deformable member 110. The terminal assembly 126 may be called a connector for a connection point. The term "terminal assembly" covers the above embodiments of the terminal assembly 126 and any equivalent thereof.

The apparatus 100 further includes a shackle bolt 124 (also called a shackle pin or a shackle lock) configured to be slideably receivable in each of the coaxially-aligned threaded shackle holes 122 that are defined by the spaced-apart lugs 120. The shackle bolt 124 is configured to lock the shackle assembly 118 and thereby prevent movement of an item through the shackle assembly 118 (in which the dimension of the item is greater than the dimension of the shackle assembly 118). The shackle bolt 124 includes, for instance, an elongated shaft portion (also called a linearly extending shaft) having an outer dimension (an outer diameter) that is smaller than the inner dimension (an inner diameter) of the coaxially-aligned threaded shackle holes 122. The elongated shaft portion is also called a pin body or an elongated body, etc. Preferably, the elongated shaft portion (of the shackle bolt 124) has a metal alloy (a strength component, etc.) that is configured to withstand the receiving and transmitting of relatively heavy loads as may be required or suitable for a specific-load carrying ability. Preferably, the elongated shaft portion of the shackle bolt 124 forms a circular cross-section. Preferably, the shackle bolt 124 includes a flange 129 (also called a handle portion or a head portion) positioned (formed) at a distal end portion (an end portion) of the shackle bolt 124. The flange 129 of the shackle bolt 124 has an outer dimension (outer diameter) that is greater than the outer dimension (outer diameter) of the elongated shaft portion of the shackle bolt 124. Preferably, the flange 129 of the shackle bolt 124 forms a circular cross-section. It will be appreciated that other equivalent embodiments or configurations are permitted for the shackle assembly 118.

Referring to the embodiment as depicted in FIG. 9, the shackle bolt 124 is not yet positioned to be slideably received in the coaxially-aligned shackle holes 122, in which the coaxially-aligned shackle holes 122 may be threaded or not threaded as may be required or desired.

Figure 10:
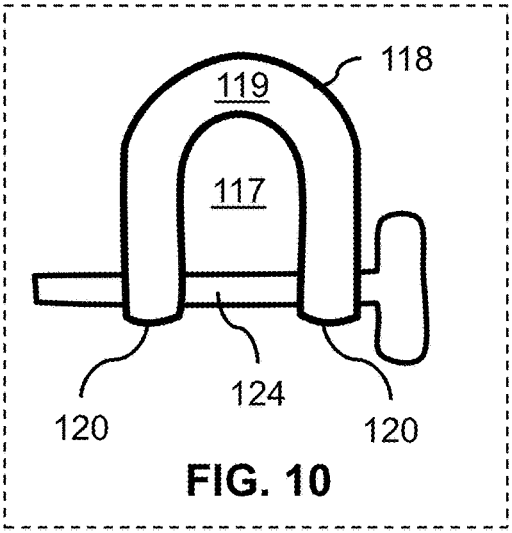

In accordance with the embodiment as depicted in FIG. 10, the shackle bolt 124 is slideably received in the coaxially-aligned threaded shackle holes 122. It will be appreciated that the shackle bolt 124 may be screwed in, threaded, bolted or pinned to the coaxially-aligned threaded shackle holes 122. For the case where the shackle bolt 124 is slideably received in the coaxially-aligned threaded shackle holes 122, a combination of the shackle assembly 118 and the shackle bolt 124 defines a jaw opening 117, in which an item may be received therethrough.

Figure 11:
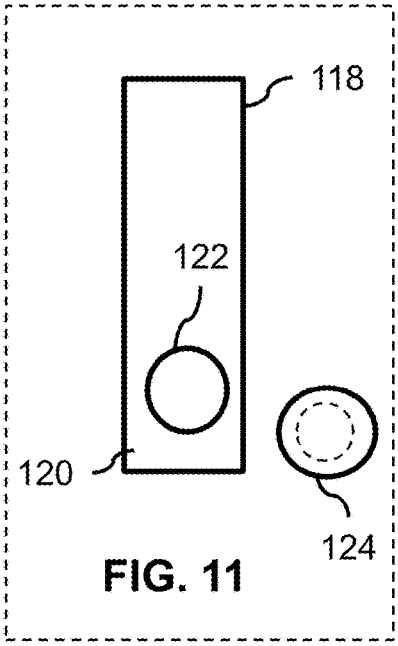
Figure 12:
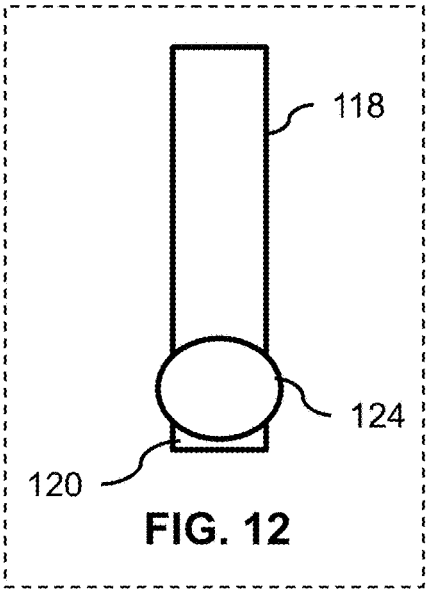

In accordance with the embodiment as depicted in FIG. 11, the shackle bolt 124 is not yet positioned to be slideably received in the coaxially-aligned threaded shackle holes 122. In accordance with the embodiment as depicted in FIG. 12, the shackle bolt 124 is slideably received in the coaxially-aligned threaded shackle holes 122.

Figure 13:
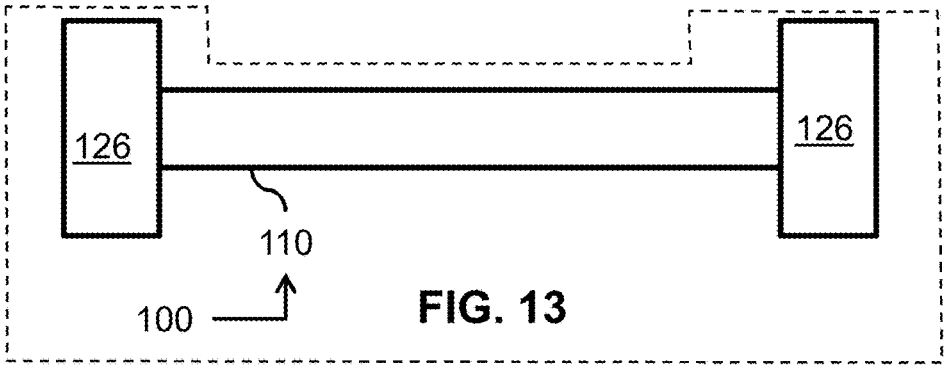
FIGS. 13 to 15 depict side views of embodiments of the apparatus of FIG. 9.
Figure 14:
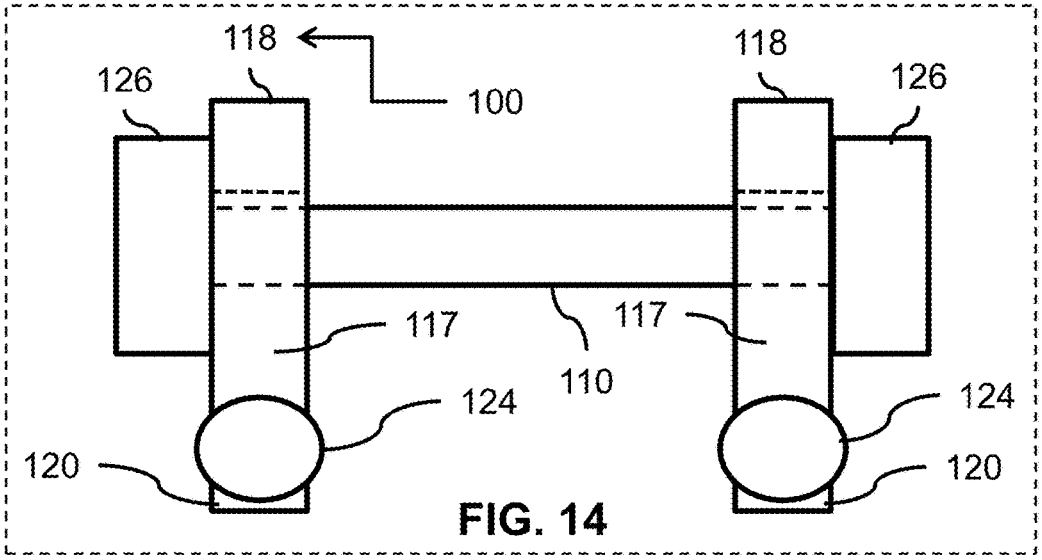
Figure 15:
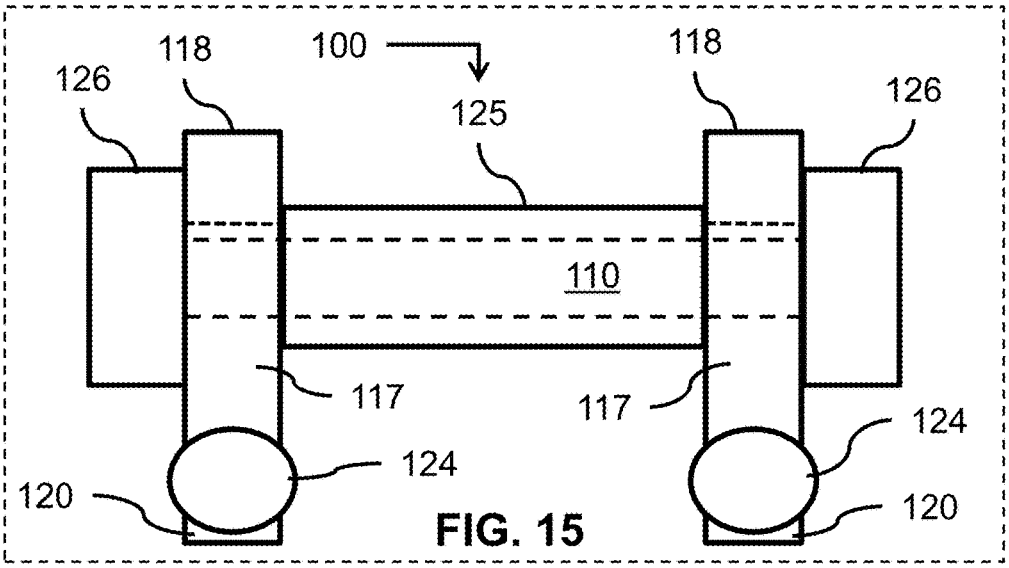

FIGS. 13 to 15 depict side views of embodiments of the apparatus 100 of FIG. 3.

In accordance with the embodiment as depicted in FIG. 13, the apparatus 100 includes an elastically deformable member 110 having opposite end portions. The elastically deformable member 110 may be called an elongated elastically deformable member, a spring member, an elastic cord, a shock cord, a bungie cord, and/or any equivalent thereof, etc. The elastically deformable member 110 may include, for instance, a nylon material, etc. The elastically deformable member 110 is configured to resume (substantially resume) its normal shape spontaneously after the removal of contraction, dilatation, or distortion forces or any other forces from the elastically deformable member 110. The elastically deformable member 110 is configured to recoil or spring back into shape (substantially into shape) after the removal of a bending, stretching, or compression force from the elastically deformable member 110. The elastically deformable member 110 is configured to have a stressed state (a deformed state or a lengthened state) and an unstressed state (a non-deformed state or a normal length state). Preferably, the elastically deformable member 110 is flexible and is not rigid (if so desired).

The apparatus 100 further includes spaced-apart shackle assemblies 118 each respectively defining a jaw opening 117, in which the elastically deformable member 110 is receivable in the jaw opening 117 defined by each of the spaced-apart shackle assemblies 118. The apparatus 100 further includes terminal assemblies 126 (which may be called block assemblies or equivalent). The terminal assemblies 126 are configured to be respectively affixed to each respective opposite end portions (end sections) of the elastically deformable member 110. The terminal assemblies 126 are configured to respectively abut and contact the spaced-apart shackle assemblies 118 once the elastically deformable member 110 is received in the jaw opening 117 defined by each of the spaced-apart shackle assemblies 118. More specifically, the terminal assemblies 126 are configured to be affixed to (either directly or indirectly) respective opposite end portions of the elastically deformable member 110. In accordance with a preferred embodiment, the outer dimension of the terminal assemblies 126 is greater than the outer dimension of the elastically deformable member 110 (if so desired).

In accordance with a preferred embodiment, the elastically deformable member 110 has a first portion and a second portion spaced apart from the first portion. For instance, in accordance with a preferred embodiment, the first portion and the second portion are the opposite end portions of the elastically deformable member 110. The spaced-apart shackle assemblies 118 each respectively define a jaw opening 117. The elastically deformable member 110 is receivable in the jaw opening 117 defined by each of the spaced-apart shackle assemblies 118. The terminal assemblies 126 are configured to be respectively affixed to the first portion and the second portion of the elastically deformable member 110.

In accordance with an embodiment, there is provided a method for operating the apparatus 100 having the elastically deformable member 110, the spaced-apart shackle assemblies 118, and the terminal assemblies 126. The method includes, and is not limited to, (A) receiving the elastically deformable member 110 in jaw openings 117 defined by spaced-apart shackle assemblies 118, in which the elastically deformable member 110 has the first portion and the second portion spaced apart from the first portion, and (B) respectively affixing the terminal assemblies 126 to the first portion and the second portion of the elastically deformable member 110.

In accordance with the embodiment as depicted in FIG. 14, the apparatus 100 includes spaced-apart shackle assemblies 118. The spaced-apart shackle assemblies 118 each respectively define a jaw opening 117 (also depicted in FIG. 10). The elastically deformable member 110 is receivable in the jaw opening 117 defined by each of the spaced-apart shackle assemblies 118.

More specifically, the spaced-apart shackle assemblies 118 each respectively have a shackle bolt 124. Specifically, the shackle bolt 124 is slideably received in the coaxially-aligned threaded shackle holes 122 (depicted in FIG. 9) defined by the spaced-apart shackle assemblies 118. For the case where the shackle bolt 124 is respectively connected to the spaced-apart shackle assemblies 118, a combination of the spaced-apart shackle assemblies 118 and the shackle bolt 124 respectively define the jaw opening 117 (also depicted in FIG. 10). The elastically deformable member 110 is received in the jaw opening 117 defined by each of the spaced-apart shackle assemblies 118.

In accordance with the embodiment as depicted in FIG. 15, the apparatus 100 further includes a protective flexible cover 125 configured to cover, at least in part, the elastically deformable member 110. The protective flexible cover 125 is configured to be flexible. This is done in such a way that the protective flexible cover 125, at least in part, and in use, covers the elastically deformable member 110 for (A) the case where the elastically deformable member 110 has been compressed or distorted, and (B) the case where the elastically deformable member 110, in use, regains its original unstressed state.

Figure 16:
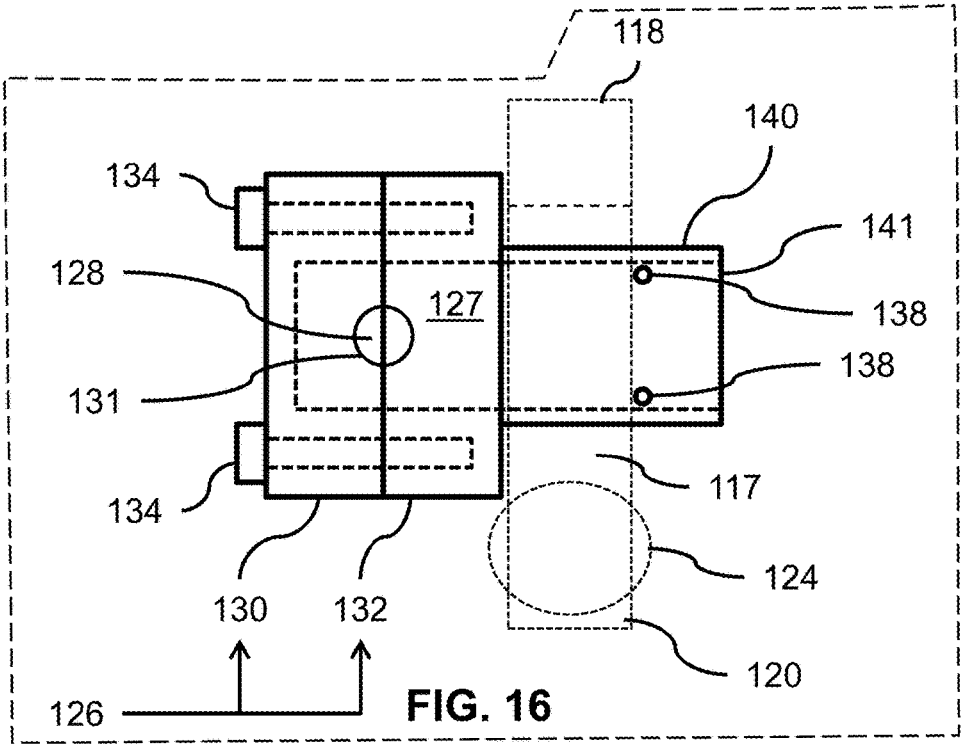
FIGS. 16 and 17 depict a side view (FIG. 16) and a front view (FIG. 17) of embodiments of the apparatus of FIG. 9.
Figure 17:
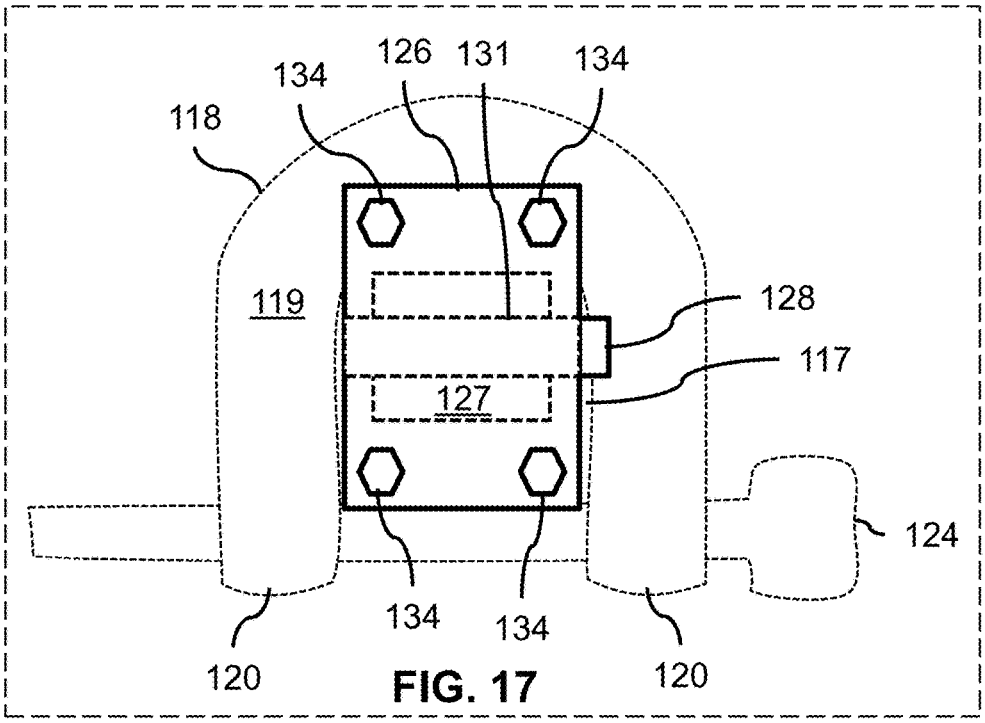

FIGS. 16 and 17 depict a side view (FIG. 16) and a front view (FIG. 17) of the embodiments of the apparatus 100 of FIG. 3.

Figure 19:
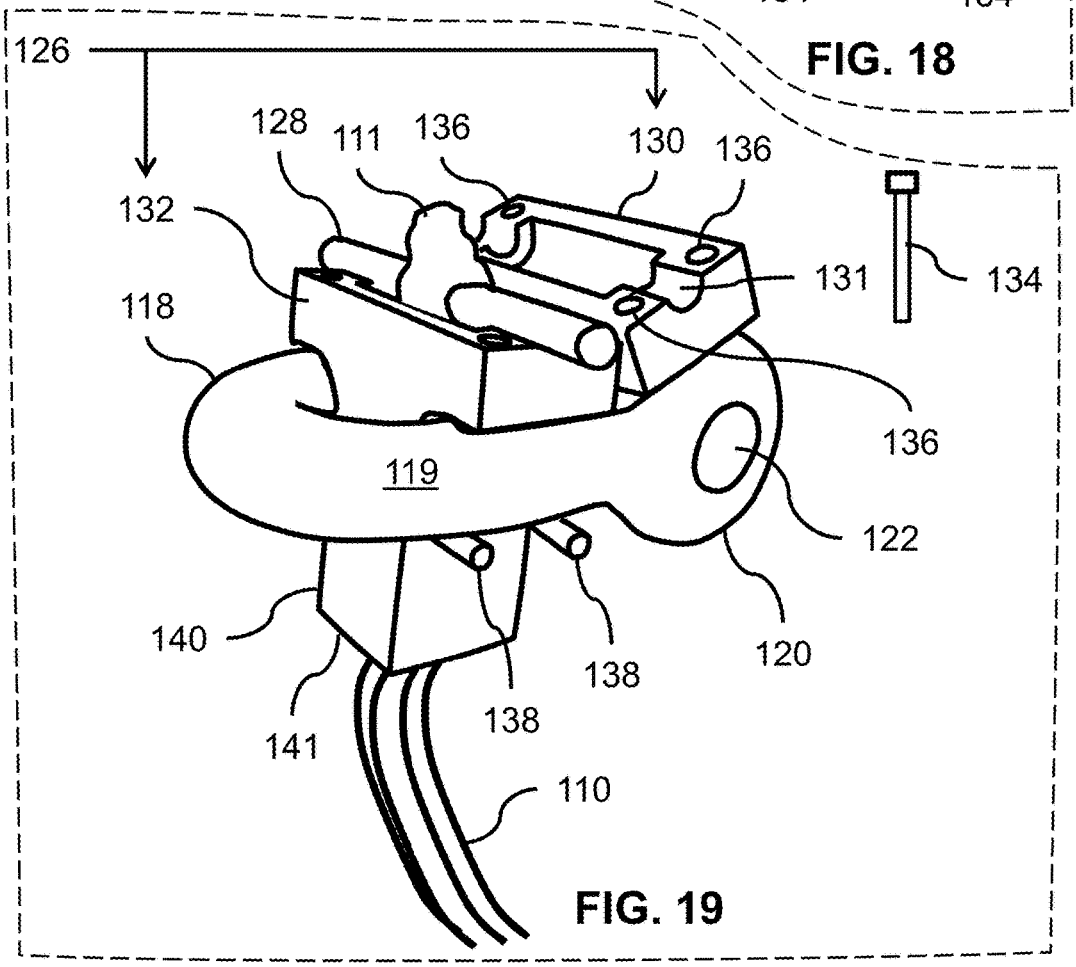

In accordance with the embodiments as depicted in FIG. 16 and FIG. 17, the terminal assembly 126 includes a first terminal portion 130 (preferably formed as a block) and a second terminal portion 132 (preferably formed as a mating block). The first terminal portion 130 and the second terminal portion 132 are configured to mate (interlock) with each other. The second terminal portion 132 is configured to abut (contact) the shackle assembly 118. The first terminal portion 130 and the second terminal portion 132 are configured to be movable relative to each other. This is done in such a way that the first terminal portion 130 and the second terminal portion 132 are positioned in any one of (A) a spaced-apart relationship relative to each other (as depicted in FIGS. 19), and (B) an abutment relationship in which the first terminal portion 130 and the second terminal portion 132, in use, contact each other (as depicted in FIG. 16). The terminal assembly 126 includes a metal, plastic, composite, fortified material, casting, and any suitable strength material, and any equivalent thereof etc.

For the case where the first terminal portion 130 and the second terminal portion 132 are positioned in an abutment relationship (as depicted in FIG. 16), in which the first terminal portion 130 and the second terminal portion 132, in use, contact each other, the first terminal portion 130 and the second terminal portion 132 (the terminal assembly 126) in combination define an internal block cavity 127, and the second terminal portion 132, in use, abuts and contacts a selected one of the shackle assemblies 118.

Connectors 134 (such as, bolts, etc.) are configured to fixedly attach and connect the first terminal portion 130 and the second terminal portion 132 together (for this case). This is done in such a way that the first terminal portion 130 and the second terminal portion 132 define, in combination, the internal block cavity 127 (once the first terminal portion 130 and the second terminal portion 132 are made to contact each other in use). The internal block cavity 127 extends out from the rear portion of the second terminal portion 132 (for access to or for receiving, at least in part, an end section of the elastically deformable member 110).

The terminal assembly 126 defines a block channel 131 extending between the opposite lateral sides of the terminal assembly 126. The block channel 131 is in fluid communication with the internal block cavity 127. The terminal assembly 126 further includes a connection member 128 (also called a block pin) that is receivable (slide receivable) in the block channel 131 defined by the terminal assembly 126. The connection member 128 is configured to be affixed (fixedly connected) to the elastically deformable member 110, as depicted in FIG. 19.

The terminal assembly 126 further includes a block extension 140. The block extension 140 extends (fixedly extends) from the second terminal portion 132. The block extension 140 extends through the jaw opening 117 defined by the shackle assembly 118. The second terminal portion 132, in use, abuts the shackle assembly 118. The outer dimension of the block extension 140 is smaller than the outer dimension of the jaw opening 117 defined by the shackle assembly 118.

Figure 18:
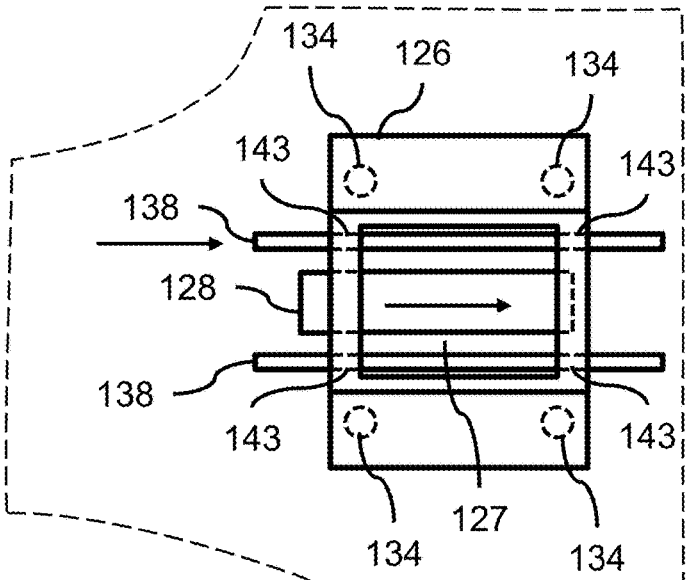
FIGS. 18 and 19 depict a rear view (FIG. 18) and a side frontal perspective view (FIG. 19) of embodiments of the apparatus of FIG. 9.

The terminal assembly 126 further includes a terminal lock 138 (also called a lock pin) that is configured to be inserted into a lock channel 143 (as depicted in FIG. 18) that is defined by the block extension 140. The terminal lock 138 is configured to lock the position of the terminal assembly 126 relative to the shackle assembly 118. The terminal lock 138 is configured to lock the position of the shackle assembly 118 relative to the terminal assembly 126. More specifically, the terminal lock 138 is configured to lock the position of the shackle assembly 118 relative to second terminal portion 132 of the terminal assembly 126. The internal block cavity 127 extends out from the rear portion of the second terminal portion 132 and through to the rear portion 141 of the block extension 140. The elastically deformable member 110 is receivable in the internal block cavity 127 via the rear portion 141 of the block extension 140 (as depicted in FIG. 19).

FIGS. 18 and 19 depict a rear view (FIG. 18) and a side frontal perspective view (FIG. 19) of the embodiments of the apparatus 100 of FIG. 3.

In accordance with the embodiment as depicted in FIG. 18, the shackle assembly 118 is not depicted in this view (for improved understanding of the terminal assembly 126). The connection member 128 is configured to slidably extend into the terminal assembly 126 in such a way that the connection member 128 slidably extends into the internal block cavity 127 defined by the terminal assembly 126. The terminal lock 138 is configured to slidably extend into the terminal assembly 126 in such a way that the terminal lock 138 slidably extends into the internal block cavity 127 defined by the terminal assembly 126. The connection member 128 and the terminal lock 138 are spaced-apart from each other once the connection member 128 and the terminal lock 138 are slide received into the terminal assembly 126.

In accordance with the embodiment as depicted in FIG. 19, the terminal assembly 126 defines connector holes 136. The connector holes 136 extend, at least in part, into the terminal assembly 126. The connector holes 136 extend entirely through the first terminal portion 130, and also extend, at least in part, into the second terminal portion 132. The connector holes 136 are respectively positioned in the corners of the first terminal portion 130 and the second terminal portion 132. The connector holes 136 are configured to respectively receive the connector 134. The first terminal portion 130 and the second terminal portion 132 are positioned in a spaced-apart relationship relative to each other (as depicted in FIG. 19). For the case where the first terminal portion 130 and the second terminal portion 132 are positioned in a spaced-apart relationship relative to each other, the elastically deformable member 110 is fixedly connected to the connection member 128. A connection 111 is configured to affix the elastically deformable member 110 to the connection member 128.

Figure 21:
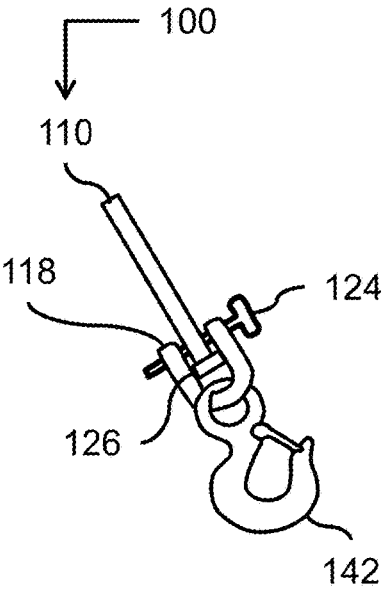
FIGS. 20 to 22 depict side views of embodiments of the apparatus of FIG. 9.
Figure 20:
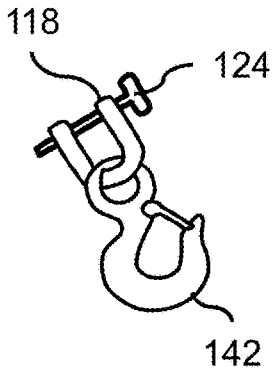
Figure 22:
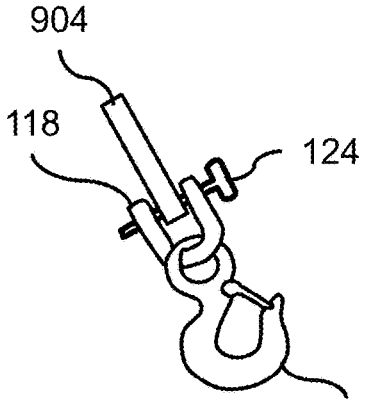

FIGS. 20-22 depict side views of a hook assembly 142 of the apparatus 100 of FIG. 3.

In accordance with the embodiment as depicted in FIG. 20, the shackle assembly 118 includes a hook assembly 142. The hook assembly 142 is coupled to the shackle assembly 118. More specifically, the hook assembly 142 defines an eyelet configured to receive the shackle assembly 118.

In accordance with the embodiment as depicted in FIG. 21, the apparatus 100 further includes the shackle assembly 118 having the hook assembly 142. The hook assembly 142 is coupled to the shackle assembly 118. More specifically, the hook assembly 142 defines an eyelet configured to receive the shackle assembly 118. The elastically deformable member 110 is connected to (affixed to) the terminal assembly 126, and the terminal assembly 126 is coupled to the shackle assembly 118.

In accordance with the embodiment as depicted in FIG. 22, the shackle assembly 118 includes the hook assembly 142. The hook assembly 142 is coupled to the shackle assembly 118. More specifically, the hook assembly 142 defines an eyelet configured to receive the shackle assembly 118. The sling assembly 904 is coupled to the shackle assembly 118. More specifically, the sling assembly 904 is coupled to the shackle bolt 124 of the shackle assembly 118.

Figure 23:
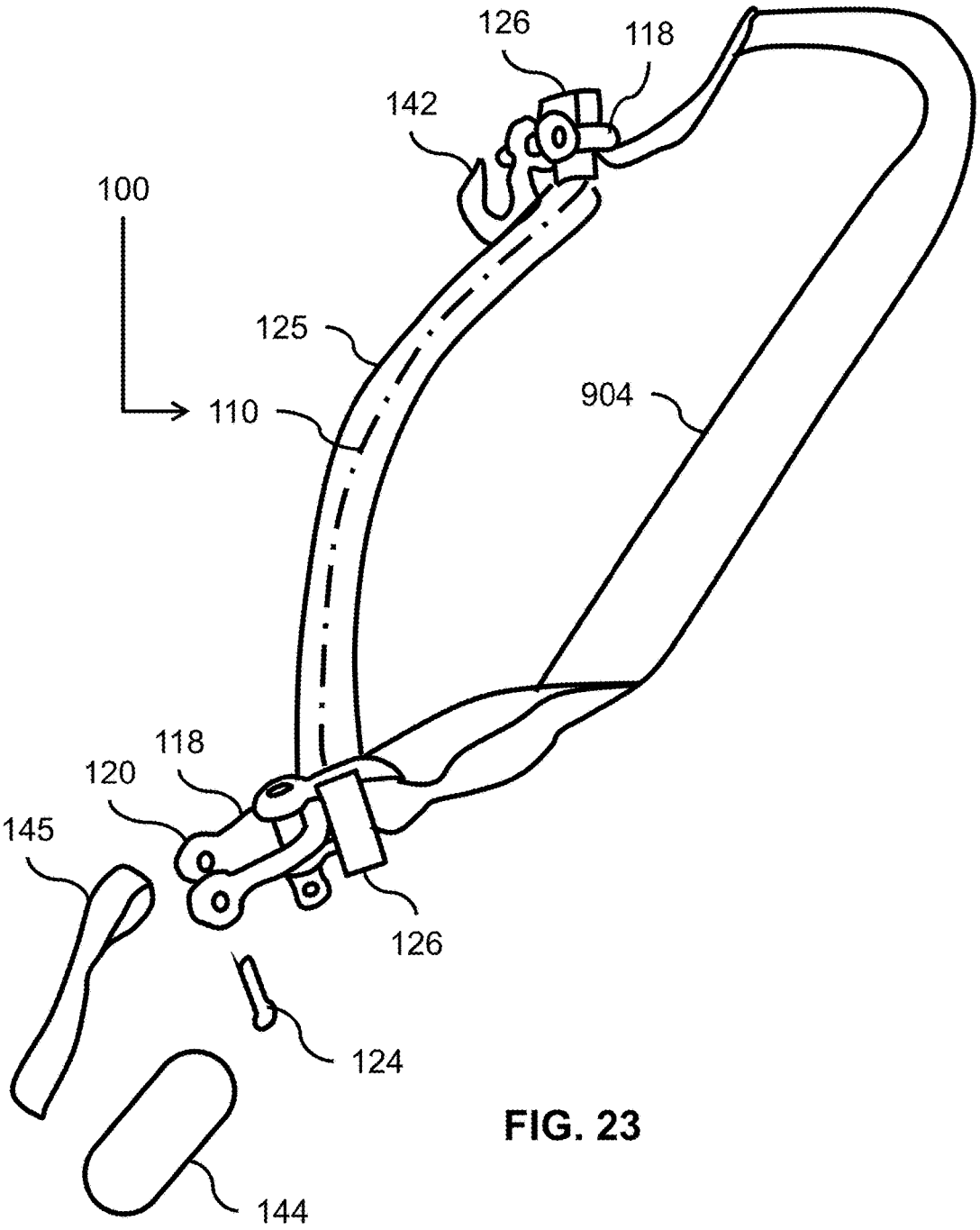
FIG. 23 depicts a perspective view of the apparatus of FIG. 9.

FIG. 23 depicts a perspective view of the apparatus 100 of FIG. 3.

In accordance with the embodiment as depicted in FIG. 23, the apparatus 100 includes the elastically deformable member 110 having end portions (end terminals) respectively affixed to terminal assemblies 126. Each of the terminal assemblies 126 is respectively coupled to a shackle assembly 118. The protective flexible cover 125 is configured to cover, at least in part, the elastically deformable member 110 that extends between the terminal assemblies 126. In accordance with an option, a main lifting ring 144 is configured to be coupled to a shackle assembly 118 (via the shackle bolt 124). The main lifting ring 144 includes a strength material (such as a metal component, etc.). In accordance with an option, an eye 145 (such as a webbing material) is configured to be coupled to a shackle assembly 118 (via the shackle bolt 124).

Figure 24:
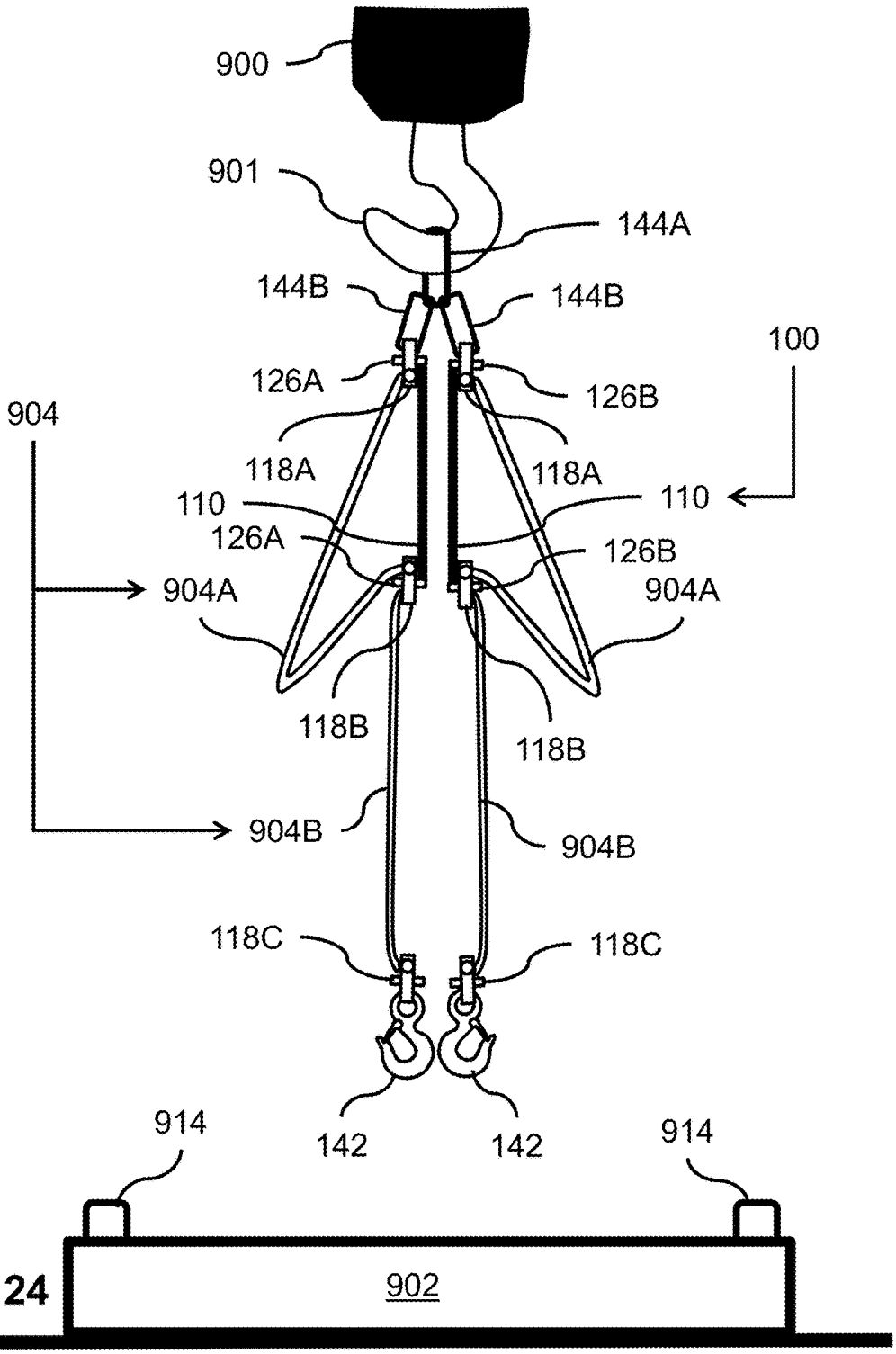
FIGS. 24 and 25 depict front views of embodiments of the apparatus of FIG. 9.
Figure 25:
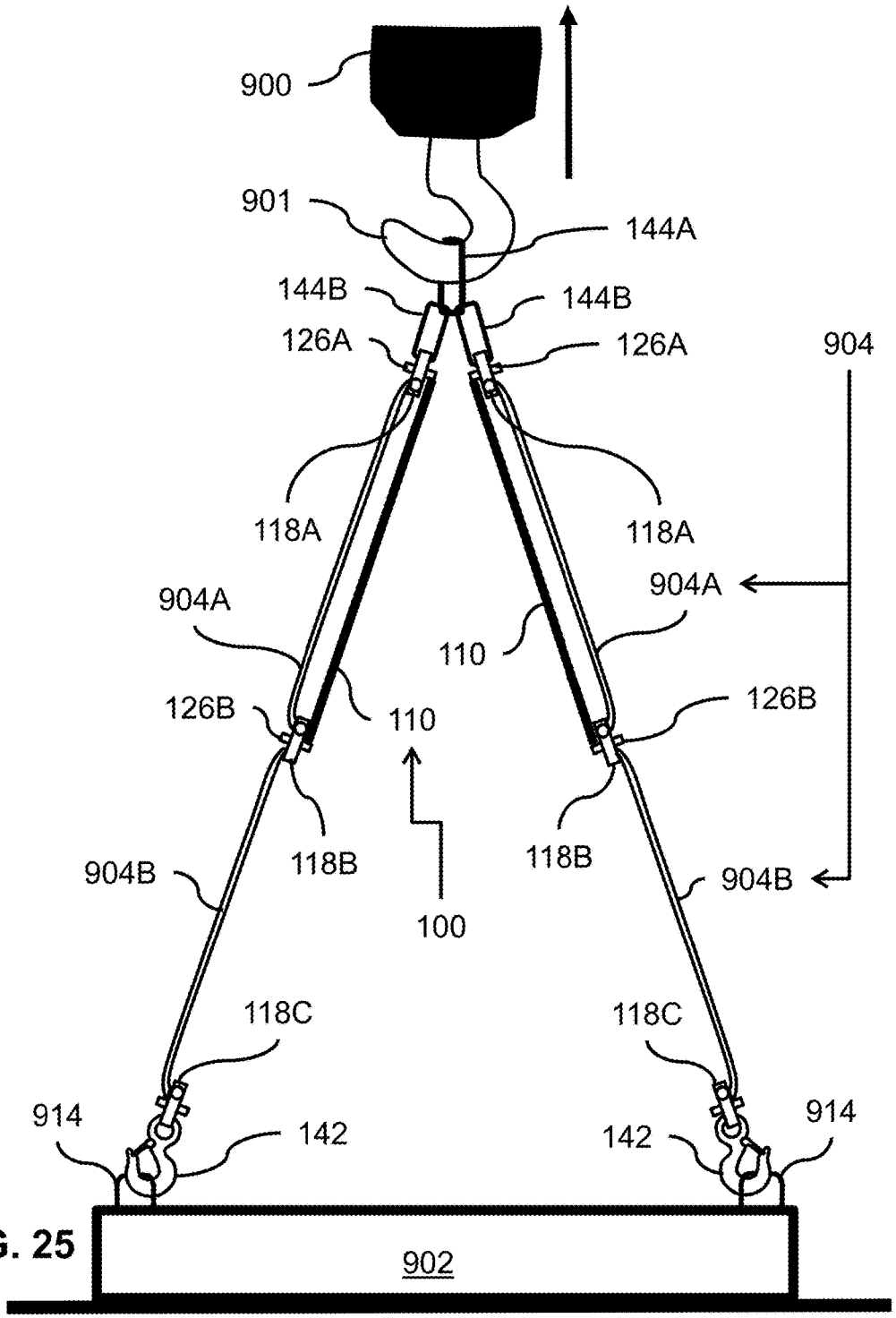

FIGS. 24 and 25 depict front views of embodiments of the apparatus 100 of FIG. 3.

In accordance with the embodiment as depicted in FIG. 24, the load 902 includes spaced-apart lug assemblies 914 that are fixedly connected to the load 902. The apparatus 100 is ready to be installed to (selectively coupled to) the load 902. The apparatus 100 is depicted in a relatively relaxed state (FIG. 24). The apparatus 100 includes the elastically deformable member 110 having opposite end portions that are respectively fixedly connected to, and extending between, a first terminal assembly 126A and a second terminal assembly 126B. The second terminal assembly 126B is spaced-apart from the first terminal assembly 126A. The first terminal assembly 126A and the second terminal assembly 126B are respectively positioned to (preferably coupled to) a first shackle assembly 118A and a second shackle assembly 118B that is spaced-apart from the first shackle assembly 118A. The sling assembly 904 (also called a load-lifting sling) includes a first sling assembly 904A and a second sling assembly 904B that is spaced-apart from the first sling assembly 904A. The first sling assembly 904A includes opposite end sections that are respectively coupled to the first shackle assembly 118A and the second shackle assembly 118B. The first shackle assembly 118A is coupled (either directly or indirectly) to the movable-node point 901 of the moving assembly 900. For instance, the first shackle assembly 118A may be coupled to the movable-node point 901 of the moving assembly 900 via a first lifting ring 144A (which is directly coupled to the movable-node point 901) and a second lifting ring 144B (which directly couples the first lifting ring 144A to the first shackle assembly 118A). The second sling assembly 904B includes opposite end terminals that are respectively coupled to (A) the second shackle assembly 118B, and (B) a load shackle assembly 118C having a hook assembly 142, in which the hook assembly 142 is configured to be selectively coupled to a selected lug assembly 914 that is fixedly connected to the load 902.

In accordance with a preferred embodiment, the elastically deformable member 110 has a first portion and a second portion spaced apart from the first portion. In accordance with a specific embodiment, the first portion and the second portion include the opposite end portions of the elastically deformable member 110. Also provided is the first terminal assembly 126A and the second terminal assembly 126B spaced apart from the first terminal assembly 126A. The first portion and the second portion of the elastically deformable member 110 are respectively fixedly connected to the first terminal assembly 126A and the second terminal assembly 126B. The first shackle assembly 118A and the second shackle assembly 118B is spaced apart from the first shackle assembly 118A. The first terminal assembly 126A and the second terminal assembly 126B are respectively positioned to (preferably coupled to) the first shackle assembly 118A and the second shackle assembly 118B.

In accordance with an embodiment, there is provided a method for operating the apparatus 100 including the elastically deformable member 110 having a first portion and a second portion spaced apart from the first portion, the first terminal assembly 126A and the second terminal assembly 126B spaced apart from the first terminal assembly 126A, and the first shackle assembly 118A and the second shackle assembly 118B spaced apart from the first shackle assembly 118A. The method includes (and is not limited to): (A) respectively fixedly connecting the first portion and the second portion of the elastically deformable member 110 to the first terminal assembly 126A and the second terminal assembly 126B, and (B) respectively positioning (preferably coupling) the first terminal assembly 126A and the second terminal assembly 126B to the first shackle assembly 118A and the second shackle assembly 118B.

In accordance with the embodiment as depicted in FIG. 25, the apparatus 100 is depicted in a relatively stressed state. The apparatus 100 is connected to the load 902, and the load 902 is lifted upwardly by the moving assembly 900. The moving assembly 900 and the movable-node point 901 are moved upwardly and the load 902 is lifted away from the working surface. The elastically deformable member 110 is stretched (elongated) in a resilient manner (resiliently deformable manner).

Figure 26:
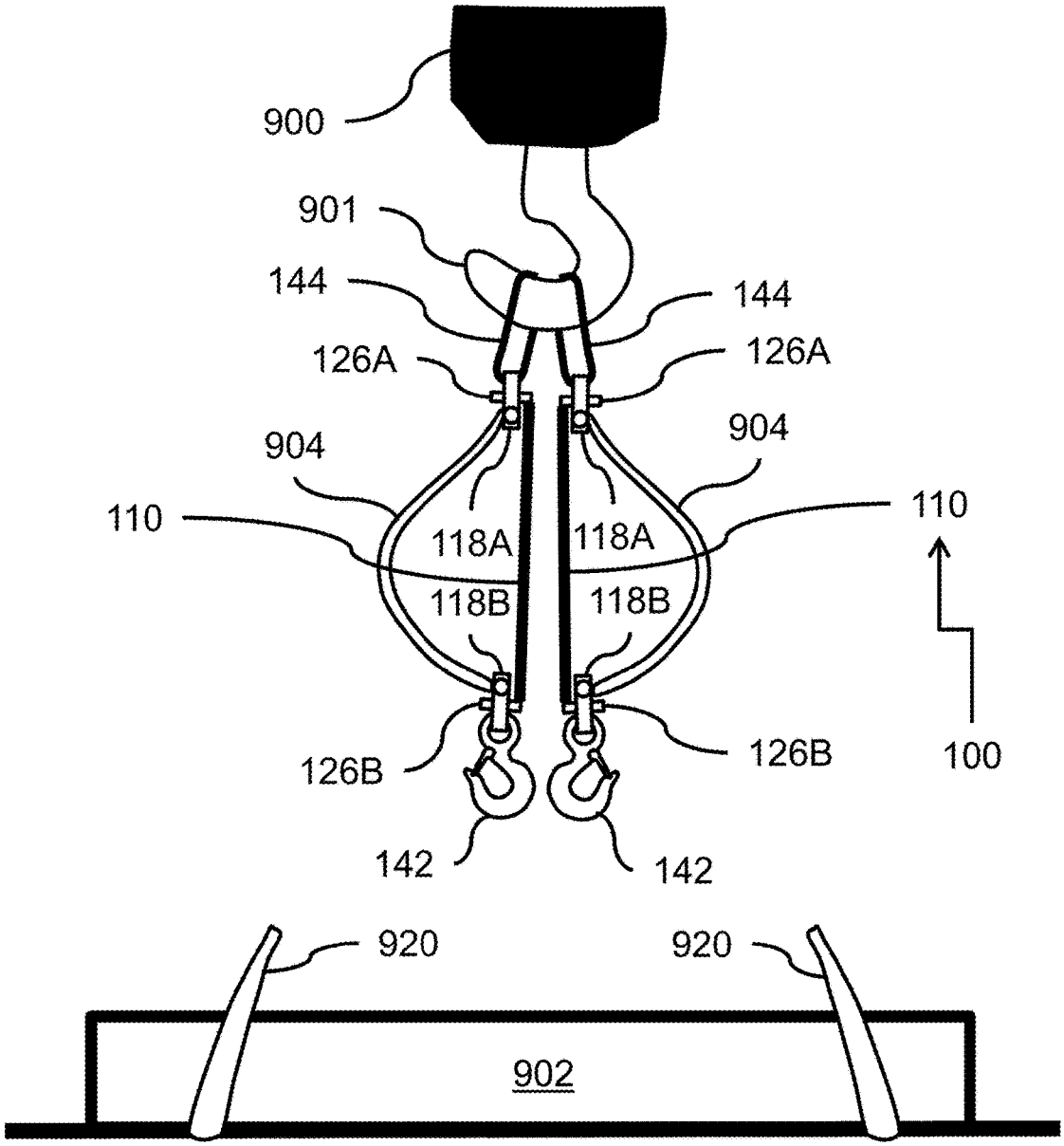
FIGS. 26 and 27 depict front views of embodiments of the apparatus of FIG. 9.
Figure 27:
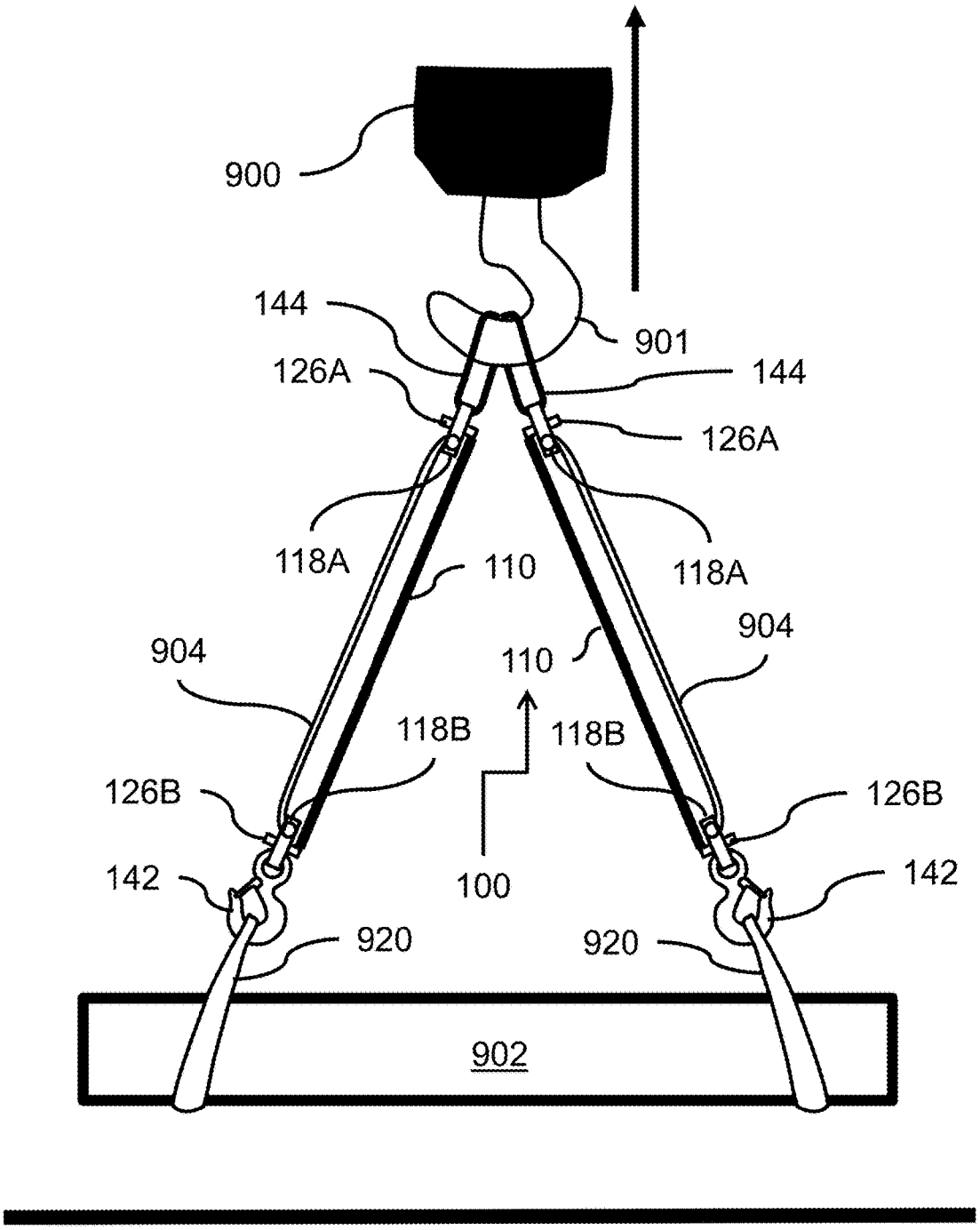

FIGS. 26 and 27 depict front views of the embodiments of the apparatus 100 of FIG. 3.

In accordance with the embodiment as depicted in FIG. 26, the load 902 includes spaced-apart hook-ups 920 (also called lead hook-ups) configured to be selectively coupled (connected to) the load 902. The apparatus 100 is depicted in a relatively relaxed state in FIG. 26. The apparatus 100 includes the elastically deformable member 110 having opposite end portions that are respectively fixedly connected to, and extending between, a first terminal assembly 126A and a second terminal assembly 126B that is spaced-apart from the first terminal assembly 126A. The first terminal assembly 126A and the second terminal assembly 126B are respectively positioned to (preferably coupled to) a first shackle assembly 118A and a second shackle assembly 118B that is spaced-apart from the first shackle assembly 118A. The sling assembly 904 is also called a load-lifting sling. The sling assembly 904 includes opposite end sections that are respectively coupled to the first shackle assembly 118A and the second shackle assembly 118B.

The first shackle assembly 118A is coupled (either directly or indirectly) to the movable-node point 901 of the moving assembly 900. For instance, the first shackle assembly 118A may be coupled to the movable-node point 901 of the moving assembly 900 via a main lifting ring 144, which is directly coupled to the movable-node point 901. The second shackle assembly 118B includes a hook assembly 142, in which the hook assembly 142 is configured to be selectively coupled to a hook-up 920 that is configured to be selectively coupled to the load 902.

In accordance with the embodiment as depicted in FIG. 27, the apparatus 100 is depicted in a relatively stressed state. The moving assembly 900 and the movable-node point 901 are moved upwardly and the load 902 is lifted away from the working surface.

Referring to the embodiments as depicted in FIGS. 25 and 27, which depicts a vertical deployment, it will be appreciated that the apparatus 100 may be used or deployed along a horizontal direction, for instance as depicted in FIGS. 8A and 8B in a towing application.

In accordance with a major embodiment, the apparatus 100 includes (and is not limited to) a synergistic combination of a load 902, a moving assembly 900, a load line, and an elastically deformable member 110. The lifting assembly is configured to move the load 902. For instance, the lifting assembly may be configured to move the load 902 vertically, or may be configured to move the load 902 horizontally. The moving assembly 900 may include a lifting assembly, a towing assembly, and any equivalent thereof. The load line may be called a lift line, a tow line, or the sling assembly 904. The load line is connected (either directly or indirectly) to (and extend between or is connected between) the moving assembly 900 and the load 902. The load line has spaced-apart points positioned on the load line. The elastically deformable member 110 is connected to the spaced-apart points of the load line.

It will be appreciated that the description and/or drawings identify and describe embodiments of the apparatus (either explicitly or non-explicitly). The apparatus may include any suitable combination and/or permutation of the technical features as identified in the detailed description, as may be required and/or desired to suit a particular technical purpose and/or technical function. It will be appreciated, that where possible and suitable, any one or more of the technical features of the apparatus may be combined with any other one or more of the technical features of the apparatus (in any combination and/or permutation). It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help understand the scope of the claims. It is believed that all the crucial aspects of the disclosed subject matter have been provided in this document. It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a load-bearing sling assembly defining spaced-apart points along the load-bearing sling assembly;

an elastically deformable tensioning member defining a first portion, and a second portion that is spaced apart from the first portion;

a first terminal assembly affixed to the first portion of the elastically deformable tensioning member;

a second terminal assembly affixed to the second portion of the elastically deformable tensioning member;

a first terminal assembly receiver defining a first jaw opening, and the first portion of the elastically deformable tensioning member being receivable in the first jaw opening defined by the first terminal assembly receiver;

a second terminal assembly receiver defining a second jaw opening, the second terminal assembly receiver being spaced apart from the first terminal assembly receiver, and the second portion of the elastically deformable tensioning member being receivable in the second jaw opening defined by the second terminal assembly receiver;

wherein the first terminal assembly is configured to abut and contact the first terminal assembly receiver once the elastically deformable tensioning member is received in the first jaw opening defined by the first terminal assembly receiver; and wherein the second terminal assembly is configured to abut and contact the second terminal assembly receiver once the elastically deformable tensioning member is received in the second jaw opening defined by the second terminal assembly receiver;

the first terminal assembly receiver being connected to a first point of the spaced-apart points of the load-bearing sling assembly;

the second terminal assembly receiver being connected to a second point of the spaced-apart points of the load-bearing sling assembly; and in which the elastically deformable tensioning member is configured to, in use, apply tension to decrease a separation distance between the spaced-apart points of the load-bearing sling assembly to remove slack in the load-bearing sling assembly.

2. The apparatus of claim 1, in which the first terminal assembly receiver is a first shackle assembly, and the second terminal assembly receiver is a second shackle assembly.

3. The apparatus of claim 2, wherein:

a selected one of the first terminal assembly and the second terminal assembly includes:

a first terminal portion;

a second terminal portion; and the second terminal portion being configured to abut and contact one of the first shackle assembly and the second shackle assembly; and the first terminal portion and the second terminal portion being configured to be movable relative to each other in such a way that the first terminal portion and the second terminal portion are positioned in any one of:

a spaced-apart relationship relative to each other; and an abutment relationship in which the first terminal portion and the second terminal portion, in use, contact each other.

4. The apparatus of claim 3, wherein:

for a case where the first terminal portion and the second terminal portion are positioned in the abutment relationship in which the first terminal portion and the second terminal portion, in use, contact each other, the first terminal portion and the second terminal portion, in combination, define an internal block cavity; and the second terminal portion, in use, abuts and contacts a selected one of the first shackle assembly and the second shackle assembly.

5. The apparatus of claim 4, wherein:

connectors are configured to fixedly attach and connect the first terminal portion and the second terminal portion together in such a way that the first terminal portion and the second terminal portion define, in combination, the internal block cavity once the first terminal portion and the second terminal portion are made to contact each other; and the internal block cavity extends out from a rear portion of the second terminal portion.

6. The apparatus of claim 4, wherein:

a selected one of the first terminal assembly and the second terminal assembly defines a block channel extending between opposite lateral sides of the selected one of the first terminal assembly and the second terminal assembly; and the block channel is in fluid communication with the internal block cavity.

7. The apparatus of claim 6, wherein:

a connection member is slide receivable in the block channel defined by a selected one of the first terminal assembly and the second terminal assembly; and the connection member is configured to be fixedly connected to the elastically deformable tensioning member.

8. The apparatus of claim 7, wherein:

the connection member is configured to slidably extend into a selected one of the first terminal assembly and the second terminal assembly in such a way that the connection member slidably extends into the internal block cavity defined by the selected one of the first terminal assembly and the second terminal assembly; and a terminal lock is configured to slidably extend into the selected one of the terminal assemblies in such a way that the terminal lock slidably extends into the internal block cavity defined by the selected one of the first terminal assembly and the second terminal assembly; and the connection member and the terminal lock are spaced-apart from each other once the connection member and the terminal lock are slide received into a selected one of the first terminal assembly and the second terminal assembly.

9. The apparatus of claim 7, wherein:

for the case where the first terminal portion and the second portion are positioned in the spaced-apart relationship relative to each other, the elastically deformable tensioning member is fixedly connected to the connection member.

10. The apparatus of claim 7, wherein:

a connection is configured to affix the elastically deformable tensioning member to the connection member.

11. The apparatus of claim 4, wherein:

a block extension extends from the second terminal portion; and the block extension extends through the first jaw opening of the first shackle assembly or the second jaw opening of the second shackle assembly; and the second terminal portion, in use, abuts and contacts a selected one of the first shackle assembly and the second shackle assembly.

12. The apparatus of claim 11, wherein:

a terminal lock is configured to be inserted into a lock channel defined by the block extension; and the terminal lock is configured to lock a position of a selected one of the first shackle assembly and the second shackle assembly relative to the second terminal portion of the selected one of the first terminal assembly and the second terminal assembly; and the internal block cavity extends out from a rear portion of the second terminal portion and through to the rear portion of the block extension; and the elastically deformable tensioning member is receivable in the internal block cavity via the rear portion of the block extension.

13. The apparatus of claim 3, wherein:

a selected one of the first terminal assembly and the second terminal assembly defines connector holes extending, at least in part, into the selected one of the first terminal assembly and the second terminal assembly; and the connector holes extend entirely through the first terminal portion, and extend, at least in part, into the second terminal portion; and the connector holes being configured to respectively receive a connector.

14. The apparatus of claim 2, wherein:

one of the first shackle assembly and the second shackle assembly has a hook assembly and is coupled to the hook assembly.

15. The apparatus of claim 2, wherein:

a first shackle bolt is slideably received in first coaxially-aligned threaded shackle holes defined by the first shackle assembly;

a second shackle bolt is slidably received in second coaxially-aligned threaded shackle holes defined by the second shackle assembly; and for a case where the first shackle bolt and the second shackle bolt are respectively connected to the first shackle assembly and the second shackle assembly, a combination of the first shackle assembly and the first shackle bolt define the first jaw opening, and a combination of the second shackle assembly and the second shackle bolt define the second jaw opening; and the elastically deformable tensioning member is received in the first jaw opening and the second jaw opening respectively defined by each of the first shackle assembly and the second shackle assembly.

16. The apparatus of claim 1, wherein:

a protective flexible cover is configured to cover, at least in part, the elastically deformable tensioning member; and the protective flexible cover is configured to be flexible in such a way that the protective flexible cover, at least in part and in use, covers the elastically deformable tensioning member for where:

the elastically deformable tensioning member has been compressed or distorted; and the elastically deformable tensioning member, in use, regains its original unstressed state.

17. The apparatus of claim 1, in which the load-bearing sling assembly comprises:

one or more of a cable, a wire, a rope and a chain; and one of more of a lifting ring, a shackle, or a hook.

18. The apparatus of claim 1, in which the load-bearing sling assembly is flexible and non-extendable when under tension.

19. The apparatus of claim 1, in which the spaced-apart points of the load-bearing sling assembly include at least one point that is in between terminal ends of the load-bearing sling assembly.

20. The apparatus of claim 1 in which the spaced-apart points include at least one point that is at a terminal end of the load-bearing sling assembly.

* * * * *